US008781375B2

(12) United States Patent
Yoshida et al.

(10) Patent No.: US 8,781,375 B2
(45) Date of Patent: Jul. 15, 2014

(54) POWDER CONTAINER, POWDER CONVEYING APPARATUS, AND IMAGE FORMING APPARATUS

(75) Inventors: Keiichi Yoshida, Kanagawa (JP); Shunji Katoh, Kanagawa (JP); Hiroshi Ikeguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 308 days.

(21) Appl. No.: 13/247,106

(22) Filed: Sep. 28, 2011

(65) Prior Publication Data

US 2012/0099902 A1 Apr. 26, 2012

(30) Foreign Application Priority Data

Oct. 21, 2010 (JP) ..... 2010-236447

(51) Int. Cl.
*G03G 15/08* (2006.01)

(52) U.S. Cl.
USPC ..... 399/262; 399/106

(58) Field of Classification Search
CPC ..... G03G 15/0882; G03G 15/0834
USPC ..... 399/106, 103, 262
See application file for complete search history.

(56) References Cited

U.S. PATENT DOCUMENTS

| | | | | |
|---|---|---|---|---|
| 5,150,807 | A * | 9/1992 | Seyfried et al. | 399/106 |
| 5,491,542 | A | 2/1996 | Nagashima et al. | |
| 6,332,065 | B1 * | 12/2001 | Howard | 399/106 |
| 6,721,525 | B2 * | 4/2004 | Wang et al. | 399/262 |
| 6,760,556 | B2 * | 7/2004 | De Kesel et al. | 399/106 |
| 6,771,921 | B2 * | 8/2004 | Katsuyama | 399/262 |
| 7,463,852 | B2 | 12/2008 | Yoshida et al. | |
| 7,599,650 | B2 | 10/2009 | Katoh et al. | |
| 8,023,855 | B2 | 9/2011 | Hattori et al. | |
| 2009/0175660 | A1 * | 7/2009 | Hosokawa et al. | 399/262 |
| 2009/0190960 | A1 | 7/2009 | Hirayama et al. | |
| 2010/0158575 | A1 * | 6/2010 | Maeshima et al. | 399/262 |
| 2010/0226682 | A1 * | 9/2010 | Tanaka et al. | 399/106 |
| 2011/0058858 | A1 | 3/2011 | Fukuda et al. | |
| 2012/0219318 | A1 * | 8/2012 | Yoshida et al. | 399/262 |
| 2012/0301188 | A1 * | 11/2012 | Yamabe et al. | 399/262 |

FOREIGN PATENT DOCUMENTS

| | | |
|---|---|---|
| CN | 1107587 A | 8/1995 |
| JP | 11-143195 | 5/1999 |
| JP | 2002-46843 | 2/2002 |
| JP | 2002-72645 | 3/2002 |
| JP | 2002-96882 | 4/2002 |
| JP | 4004011 | 8/2007 |

OTHER PUBLICATIONS

Chinese Office Action issued Feb. 5, 2013, in China Patent Application No. 201110322240.X (with English translation).

* cited by examiner

*Primary Examiner* — Susan Lee
(74) *Attorney, Agent, or Firm* — Oblon, Spivak, McClelland, Maier & Neustadt, L.L.P.

(57) ABSTRACT

A powder container includes: a powder containing unit that contains powder and at least a part of which is deformable; a discharging unit that receives the powder supplied from an opening of the powder containing unit via an inlet arranged on the discharging unit and discharges the powder to a supply destination; an elastic member that is arranged on a periphery of the inlet of the discharging unit; and a seal member that is arranged on the powder containing unit and seals the opening. The seal member is sandwiched between the discharging unit and the powder containing unit via the elastic member such that the seal member is removable from between the discharging unit and the powder containing unit.

17 Claims, 16 Drawing Sheets

POWDER CONTAINER, POWDER CONVEYING APPARATUS, AND IMAGE FORMING APPARATUS

CROSS-REFERENCE TO RELATED APPLICATIONS

The present application claims priority to and incorporates by reference the entire contents of Japanese Patent Application No. 2010-236447 filed in Japan on Oct. 21, 2010.

BACKGROUND OF THE INVENTION

1. Field of the Invention

The present invention relates to a powder container that contains powder, a powder conveying apparatus that conveys the powder contained in the powder container to discharge the powder, and an image forming apparatus that includes the powder conveying apparatus.

2. Description of the Related Art

Electrophotographic image forming apparatuses, such as copiers, printers, facsimile machines, or multifunction peripherals having functions of copiers, printers and facsimile machines, generally form images by causing developing devices to form toner images with developer called toner or carrier. In such image forming apparatuses, toner is consumed through image formation; therefore, in general, toner cartridges containing toner are attached to the image forming apparatuses and when the toner cartridges become empty of the toner, the toner cartridges are replaced with new ones in order to replenish new toner.

For example, Japanese Patent Application Laid-open No. H11-143195 discloses a developer supply container (a toner cartridge) having a deformable container body. In this configuration, when a used toner supply container is to be replaced with new one, the used toner supply container is detached, a seal member on a container body of a new toner supply container is removed so that a toner outlet is opened, and the new toner supply container is placed at a predetermined position in an attachment portion of a main body of an image forming apparatus.

However, with the developer supply container disclosed in Japanese Patent Application Laid-open No. H11-143195, because the seal member is removed and the toner outlet is opened before the toner supply container is attached to the image forming apparatus, such trouble may occur that a user becomes stained with toner by touching the contained toner through the opened toner outlet or toner is scattered from the toner outlet.

SUMMARY OF THE INVENTION

It is an object of the present invention to at least partially solve the problems in the conventional technology.

According to an aspect of the present invention, there is provided a powder container includes: a powder containing unit that contains powder and at least a part of which is deformable; a discharging unit that receives the powder supplied from an opening of the powder containing unit via an inlet arranged on the discharging unit and discharges the powder to a supply destination; an elastic member that is arranged on a periphery of the inlet of the discharging unit; and a seal member that is arranged on the powder containing unit and seals the opening. The seal member is sandwiched between the discharging unit and the powder containing unit via the elastic member such that the seal member is removable from between the discharging unit and the powder containing unit.

According to another aspect of the present invention, there is provided a powder conveying apparatus including: a powder containing unit that contains powder and at least a part of which is deformable; a discharging unit that receives the powder supplied from an opening of the powder containing unit via an inlet arranged on the discharging unit and discharges the powder to a supply destination; a delivery member that moves toward the discharging unit while pushing a deformable portion of the powder containing unit inward, thereby delivering the powder to the discharging unit; and the powder container mentioned above.

According to another aspect of the present invention, there is provided an image forming apparatus including the powder conveying apparatus mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
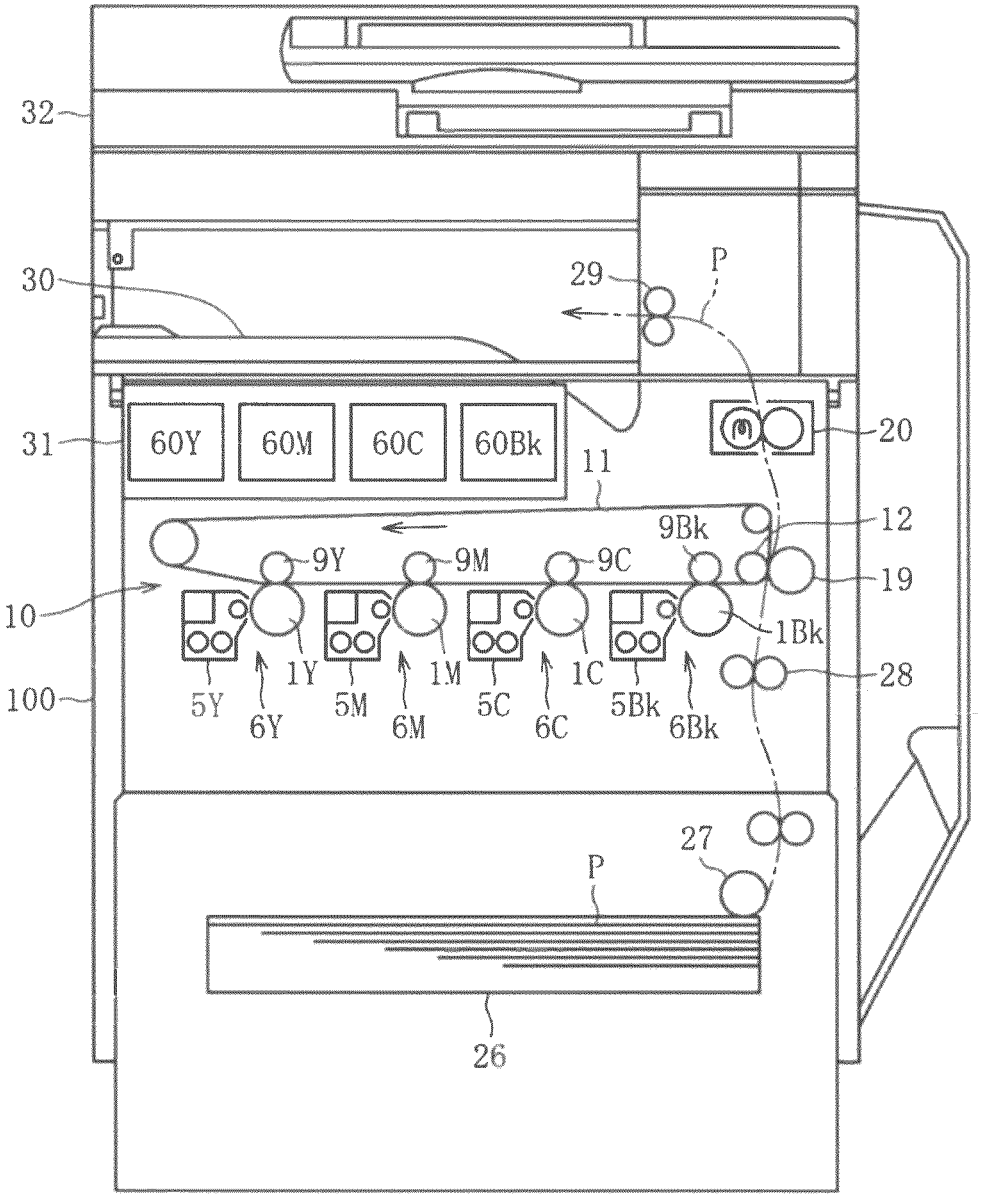
FIG. 1 is a configuration diagram of a printer as an image forming apparatus according to the present embodiment.

Exemplary embodiments ill be described below with reference to the accompanying drawings. In the drawings, the same or equivalent components are denoted by the same reference numerals and redundant explanation will be appropriately simplified or will not be repeated.

An overall configuration and operations of an image forming apparatus will be described below with reference to FIGS. 1 and 2.

FIG. 1 is a configuration diagram of a printer as the image forming apparatus. FIG. 2 is an enlarged view of an image forming unit of the image forming apparatus.

As illustrated in FIG. 1, image forming units 6Y, 6M, 6C, and 6Bk corresponding to respective colors (yellow, magenta, cyan, and black) are arranged side by side and opposite to an intermediate transfer belt 11 of an intermediate transfer unit 10. The four image forming units 6Y, 6M, 6C, and 6Bk installed in an apparatus main body 100 have substantially the same configurations except for colors of toner to be used in image formation processes. Therefore, in FIG. 2, alphabets (Y, M, C, and Bk) assigned to the image forming units 6, photosensitive drums 1, and primary transfer bias rollers 9 are omitted.

Figure 2:
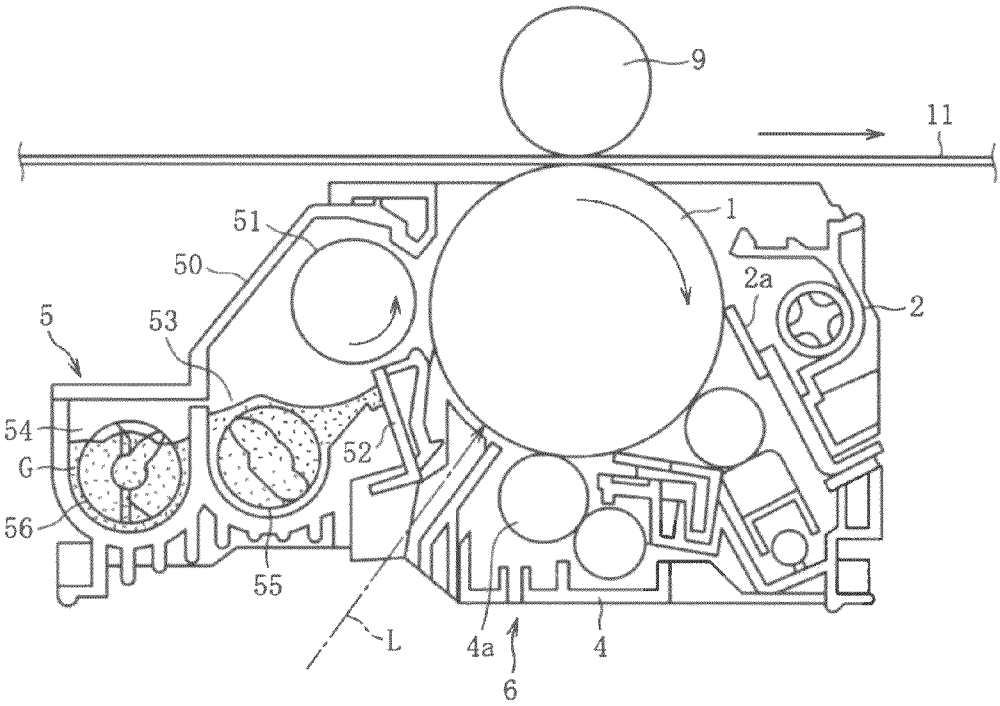
FIG. 2 is an enlarged view of an image forming unit of the image forming apparatus.

As illustrated in FIG. 2, the image forming unit 6 includes the photosensitive drum 1 as an image carrier and includes a charging unit 4, a developing device 5 as a developing unit, and a cleaning unit 2, which are arranged around the photosensitive drum 1 (only the developing devices 5 are illustrated in FIG. 1). The image formation processes (a charging process, an exposing process, a developing process, a transfer process, and a cleaning process) are performed on the photosensitive drum 1, so that a desired toner image is formed on the photosensitive drum 1.

Each of the photosensitive drum 1, the charging unit 4, the developing device 5, and the cleaning unit 2 in the image forming unit 6 is detachably attached to the apparatus main body 100 of the image forming apparatus. Each unit can be replaced with new own when the unit ends its life.

In the present embodiment, each of the photosensitive drum 1, the charging unit 4, the developing device 5, and the cleaning unit 2 in the image forming unit 6 is configured as one independent unit. However, these units can be integrated as a process unit that can be detachably attached to the apparatus main body 100. In this case, the maintenance operability of the image forming unit 6 can be improved.

The configuration of the developing device 5 in the image forming unit 6 will be described in detail below with reference to FIG. 2.

As illustrated in FIG. 2, the developing device 5 includes a developing roller 51 as a developer carrier arranged opposite to the photosensitive drum 1; a doctor blade 52 as a developer regulating member arranged below the developing roller 51; two conveying screws 55 and 56 as developer stirring conveying members arranged inside developer containers 53 and 54, respectively; and a case 50 for containing developer G. As the developer G, one-component developer formed of toner is used. A toner concentration sensor (not illustrated) for detecting the toner concentration in the developer G is arranged in the developing device 5.

As illustrated in FIG. 2, the photosensitive drum 1 is rotated clockwise in FIG. 2 by a driving unit (not illustrated). A charging roller 4*a* uniformly charges the surface of the photosensitive drum 1 at the position of the charging unit 4 (the charging process).

The surface of the photosensitive drum 1 reaches an irradiation position of laser light L emitted from an exposing unit (not illustrated) and an electrostatic latent image is formed on the surface by exposure scanning (the exposing process) at this position.

The surface of the photosensitive drum 1 reaches a position opposing to the developing roller 51 of the developing device 5. At this position, the electrostatic latent image is developed, so that a desired toner image is formed (the developing process).

The surface of the photosensitive drum 1 reaches a position opposing to both of the intermediate transfer belt 11 and the primary transfer bias roller 9. At this position, the toner image on the photosensitive drum 1 is transferred to the intermediate transfer belt 11 (the primary transfer process). At this time, a small amount of residual toner remains on the photosensitive drum 1.

The surface of the photosensitive drum 1 reaches a position opposing to the cleaning unit 2. At this position, a cleaning blade 2*a* collects the residual toner remaining on the photosensitive drum 1 (the cleaning process).

The surface of the photosensitive drum 1 reaches a position opposing to a neutralizing unit (not illustrated). At this position, a residual potential on the photosensitive drum 1 is removed.

As described above, a series of the image formation processes performed on the photosensitive drum 1 is completed.

The image formation processes described above are performed on each of the four image forming units 6Y, 6M, 6C, and 6Bk. That is, the exposing unit (not illustrated) arranged below the image forming units applies the laser light L (see FIG. 2) to the photosensitive drum 1 of each of the image forming units 6Y, 6M, 6C, and 6Bk on the basis of image information read by a reading unit 32 illustrated in FIG. 1. More specifically, the exposing unit emits the laser light L from a light source and irradiates the photosensitive drum 1 with the laser light L via a plurality of optical elements while scanning the laser light L by a polygon mirror that is being rotated. Thereafter, toner images of the respective colors formed on the photosensitive drums 1 through the developing process are transferred to the intermediate transfer belt 11 in a superimposed manner. Consequently, a color image is formed on the intermediate transfer belt 11.

The four primary transfer bias rollers 9Y, 9M, 9C, and 9Bk and the photosensitive drums 1Y, 1M, 1C, and 1Bk sandwich the intermediate transfer belt 11, so that respective primary transfer nips are formed. A transfer bias voltage with a polarity opposite to the polarity of toner is applied to each of the primary transfer bias rollers 9Y, 9M, 9C, and 9Bk.

The intermediate transfer belt 11 moves in the direction of an arrow in the figure and sequentially passes through the primary transfer nips of the primary transfer bias rollers 9Y, 9M, 9C, and 9Bk. Accordingly, the toner images of the respective colors on the photosensitive drums 1Y, 1M, 1C, and 1Bk are primary transferred to the intermediate transfer belt 11 in a superimposed manner.

The intermediate transfer belt 11 on which the toner images of the respective colors are transferred in the superimposed manner reaches a position opposing to a secondary transfer roller 19. At this position, a secondary transfer backup roller 12 and the secondary transfer roller 19 sandwich the intermediate transfer belt 11, so that a secondary transfer nip is formed. The color toner image formed on the intermediate transfer belt 11 is transferred to a transfer material P, such as a transfer sheet, conveyed to the position of the secondary transfer nip. At this time, residual toner that has not been transferred to the transfer material P remains on the intermediate transfer belt 11. The residual toner on the intermediate transfer belt 11 is removed by a belt cleaning device (not illustrated).

As described above, a series of transfer processes performed on the intermediate transfer belt 11 is completed.

The transfer material P is conveyed to the position of the secondary transfer nip from a feeding unit 26 arranged below the apparatus main body 100 via a feed roller 27, a registration roller pair 28, and the like.

More specifically, a plurality of transfer materials P, such as transfer sheets, is housed in the feeding unit 26 in a stacked manner. When the feed roller 27 is rotated counterclockwise in FIG. 1, the topmost transfer material P is fed toward a nip between rollers of the registration roller pair 28.

The transfer material P conveyed to the registration roller pair 28 temporarily stops at a position of the roller nip of the registration roller pair 28 whose rotation is stopped. Thereafter, the registration roller pair 28 is rotated and the transfer material P is conveyed toward the secondary transfer nip in synchronization with a timing of the color image on the intermediate transfer belt 11. Accordingly, a desired color image is transferred to the transfer material P.

The transfer material P on which the color image is transferred at the position of the secondary transfer nip is further conveyed to a position of a fuser unit 20. At this position, the color image transferred on the surface of the transfer material P is fixed to the transfer material P due to heat and pressure applied by a fuser roller and a pressing roller.

Thereafter, the transfer material P passes through a nip between rollers of a discharge roller pair 29 and is discharged to the outside of the apparatus. The transfer material P discharged to the outside of the apparatus main body 100 by the discharge roller pair 29 is stacked, as an output image, on a stacking unit 30.

As described above, a series of the image formation processes in the image forming unit is completed.

In FIG. 1, a toner supply unit 31 is arranged above the intermediate transfer unit 10. The toner supply unit 31 includes four toner supply devices 60Y, 60M, 60C, and 60Bk, each of which is filled with toner of a corresponding color. A toner conveying path is extended from each of the toner supply devices 60Y, 60M, 60C, and 60Bk to corresponding one of the developing devices 5Y, 5M, 5C, and 5Bk. Toner is supplied from the toner supply devices 60Y, 60M, 60C, and 60Bk to the developing devices 5Y, 5M, 5C, and 5Bk via the respective toner conveying paths. Therefore, it is possible to supply toner in accordance with the consumption amount of toner in each of the developing devices 5Y, 5M, 5C, and 5Bk. Consequently, the developing devices can be used for a long period of time.

The four toner supply devices 60Y, 60M, 60C, and 60Bk have the same configurations except for colors of toner contained therein. Therefore, in the following, the configuration of only one toner supply device will be described.

Figure 3:
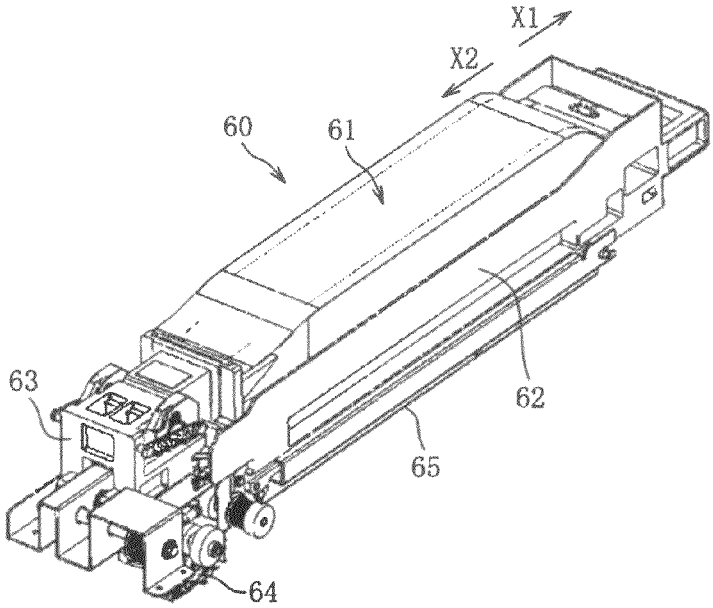
FIG. 3 is a perspective view of a toner supply device.

FIG. 3 is a perspective view of the toner supply device. In FIG. 3, an alphabet (Y, M, C, or Bk) assigned to the toner supply device 60 is omitted.

As illustrated in FIG. 3, the toner supply device 60 includes a toner cartridge 61 as a toner container (a powder container) that is filled with toner; a pullout tray 62 as a holder member that holds the toner cartridge 61; a fixing unit 63 that fixes the toner cartridge 61; and a sub hopper 64 that accumulates toner discharged from the toner cartridge 61. A toner conveying pipe (not illustrated) for conveying the toner accumulated in the sub hopper 64 toward the developing device is connected to the sub hopper 64.

The pullout tray 62 is mounted so that the pullout tray 62 can move in the horizontal direction relative to a main-body frame 65. When the pullout tray 62 is moved in a direction of an arrow X1 in the figure, the pullout tray 62 is pulled out of the apparatus main body. On the other hand, when the pullout tray 62 is moved in a direction of an arrow X2, the pullout tray 62 is housed in the apparatus main body.

Figure 4A:
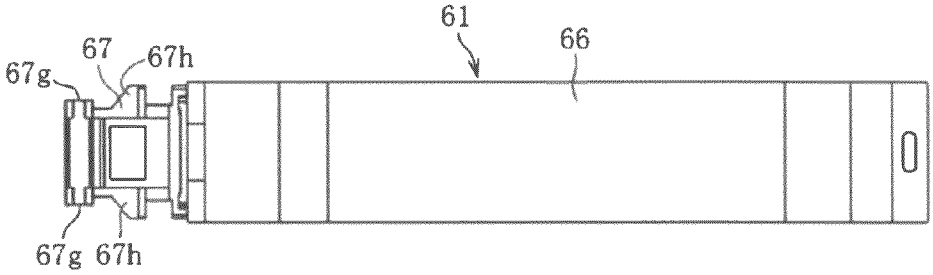
FIGS. 4A to 4D are configuration diagrams of a toner cartridge.
Figure 4B:
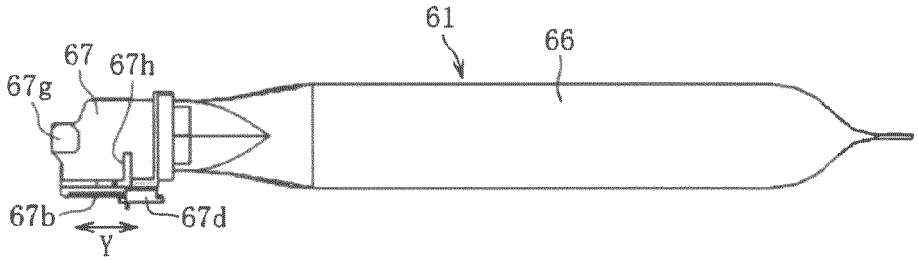
Figure 4C:
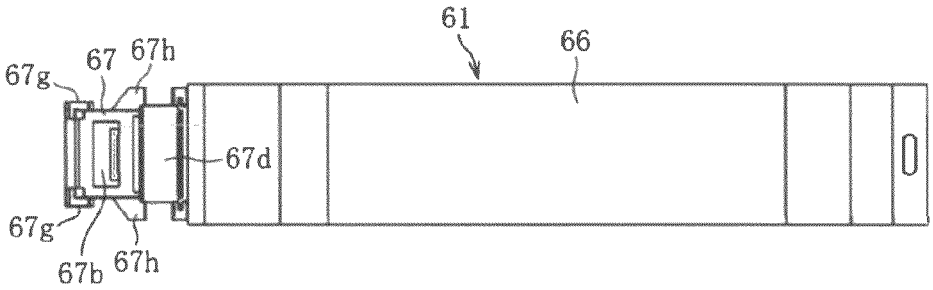
Figure 4D:
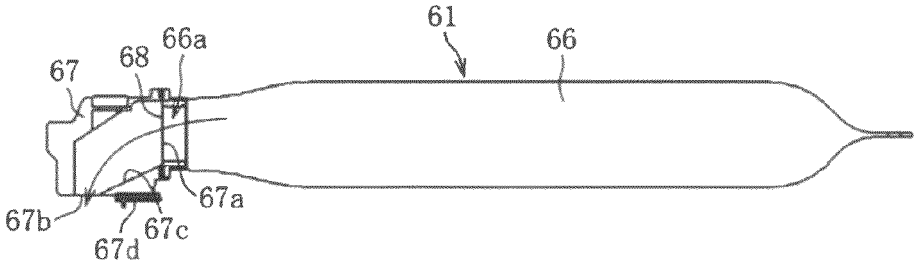

FIGS. 4A to 4D are configuration diagrams of the toner cartridge 61. Specifically, FIG. 4A is a plan view, FIG. 4B is a side view, FIG. 4C is a bottom view, and FIG. 4D is a cross-sectional view of the toner cartridge 61.

As illustrated in FIGS. 4A to 4D, the toner cartridge 61 includes a toner containing unit (a powder containing unit) 66 for containing toner as powder; and a discharging unit 67 for discharging toner from the toner containing unit 66 to the sub hopper that is a supply destination.

As illustrated in FIG. 4D, the toner containing unit 66 is a deformable longitudinal bag member with an opening 66*a* that is opened on one side thereof. As a material of the toner containing unit 66, a flexible material is used, such as a thin sheet material made of PET (polyethylene terephthalate). The toner containing unit 66 illustrated in FIGS. 4A to 4D is formed by bonding four sheet members. However, the toner containing unit 66 can be formed in a bag shape by connecting sides of one sheet material. The toner containing unit 66 includes an opening holder member 68 that keeps the opening 66*a* open so that toner can be easily supplied through the opening 66*a*.

The discharging unit 67 includes an inlet 67*a* for introducing toner; and a discharge port 67*b* for discharging toner. In the embodiment, the discharge port 67*b* is arranged so as to face downward. Therefore, it is possible to allow toner to fall from the discharge port 67*b* to the sub hopper 64 by weight, enabling to simplify the configuration for discharging toner. An inclined surface 67*c*, which is inclined downward from the inlet 67*a* to the discharge port 67*b*, is arranged in the discharging unit 67 so that the toner can smoothly be conveyed to the discharge port 67*b*. It is preferable to set the inclination angle of the inclined surface 67*c* with respect to the horizontal plane to be 10° or greater. A slide shutter 67*d* for opening and closing the discharge port 67*b* is arranged on the bottom surface (the lower surface) of the discharge port 67*b* so that the slide shutter 67*d* can slide in a direction of an arrow Y in FIG. 4B.

Figure 5A:
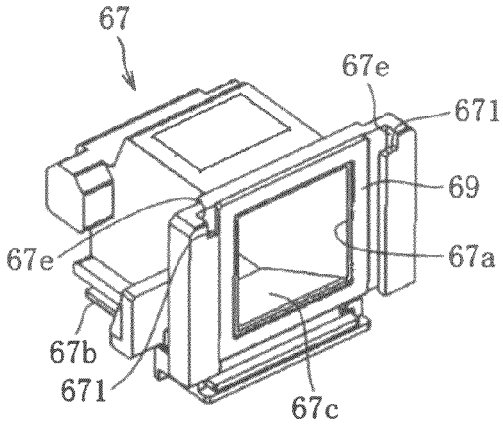
FIGS. 5A to 5C are exploded views of the toner cartridge.
Figure 5B:
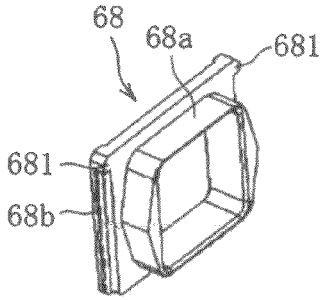
Figure 5C:
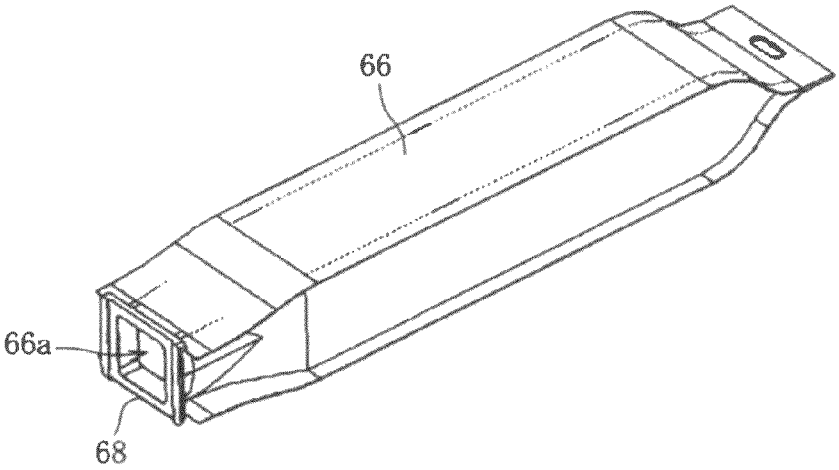

FIGS. 5A to 5C are exploded views of the toner cartridge 61. Specifically, FIG. 5A is a perspective view of the discharging unit 67, FIG. 5B is a perspective view of the opening holder member 68, and FIG. 5C is a perspective view of the opening holder member 68 arranged on the toner containing unit 66.

As illustrated in FIG. 5B, the opening holder member 68 includes a short tubular insertion member 68*a* and a flange-shaped connection portion 68*b*, which are integrated with each other. As illustrated in FIG. 5C, the insertion member 68*a* is insertable into the opening 66*a* of the toner containing unit 66. In the embodiment, the toner containing unit 66 and the opening holder member 68 are bonded by thermal welding; however, it is possible to bond them with adhesive agent.

The outer shape of the insertion member 68*a* is an approximate hexagon so that an insertion portion of the insertion member 68*a* can be easily held in the vertical direction in FIG. 5C at the time of the thermal welding.

As illustrated in FIG. 5A, a pair of grooves 67*e* that can be engaged with the connection portion 68*b* of the opening holder member 68 is arranged on the inlet 67*a* side of the discharging unit 67. After the opening holder member 68 is inserted and bonded to the toner containing unit 66 as described above, the opening holder member 68 is inserted and engaged with the grooves 67*e* from above, so that the toner containing unit 66 and the discharging unit 67 are integrally connected to each other. Upper end portions 681 at both corners of the connection portion 68*b* to be engaged with the pair of the grooves 67*e* are made thicker than other portions as illustrated in the figure. The thick upper end portions 681 serve as contact portions that come into contact with upper end portions 671 of the grooves 67*e*. That is, when the opening holder member 68 slides along the grooves 67*e* and set at a predetermined position, the upper end portions 681 of the opening holder member 68 come into contact with the upper end portions 671 of the grooves 67*e*, so that further downward movement of the opening holder member 68 can be regulated. A ring-shaped elastic member 69 is arranged on the periphery of the inlet 67*a* of the discharging unit 67 in order to seal a connected portion between the discharging unit 67 and the opening holder member 68 and to prevent toner leakage from the connected portion.

Figure 6A:
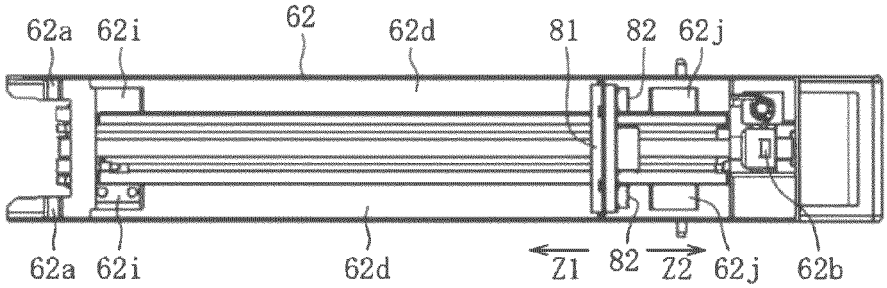
FIG. 6A is a plan view of a pullout tray before the toner cartridge is attached.
Figure 6B:
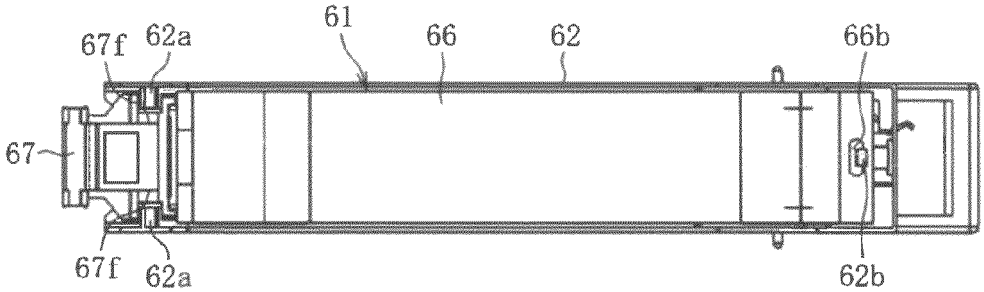
FIG. 6B is a plan view the pullout tray after the toner cartridge is attached.

FIG. 6A is a plan view of the pullout tray 62 before the toner cartridge 61 is attached. FIG. 6B is a plan view of the pullout tray 62 after the toner cartridge 61 is attached.

As illustrated in FIG. 6B, concave portions 67*f* are arranged on both side surfaces of the discharging unit 67. Convex portions 62*a* are arranged on the pullout tray 62 so as to correspond to the positions of the concave portions 67*f*, so that the convex portions 62*a* can be inserted into the concave portions 67*f*. A hole portion 66*b*, which is a to-be-engaged portion to be engaged with an engaging portion of other unit, is formed on an end portion of the toner containing unit 66 on the side opposite to the discharging unit 67 side. A hook-shaped hook portion 62*b* as the engaging portion is arranged on the pullout tray 62 so as to correspond to the position of the hole portion 66*b*.

By inserting the hook portion 62*b* to the hole portion 66*b* so that they are engaged with each other and inserting the convex portions 62*a* into the concave portions 67*f*, the toner cartridge 61 is attached to the pullout tray 62. When the toner cartridge 61 is attached as described above, the convex portions 62*a* and the concave portions 67*f* are not in contact with each other. However, when the toner cartridge 61 moves in the longitudinal direction along with the pullout tray 62 being pulled out of the apparatus main body or being housed in the apparatus main body, the convex portions 62*a* come into contact with the concave portions 67*f*, so that the movement of the toner cartridge 61 in the longitudinal direction can be regulated.

When the toner cartridge 61 is detached from the pullout tray 62, the concave portions 67*f* are separated from the convex portions 62*a* and the hook portion 62*b* is disengaged from the hole portion 66*b*. In the embodiment, the convex portions 62*a* (or the concave portions 67*f*) have the same shapes; however, if the shapes are made different, it is possible to prevent the toner cartridge 61 from being erroneously attached.

Figure 7A:
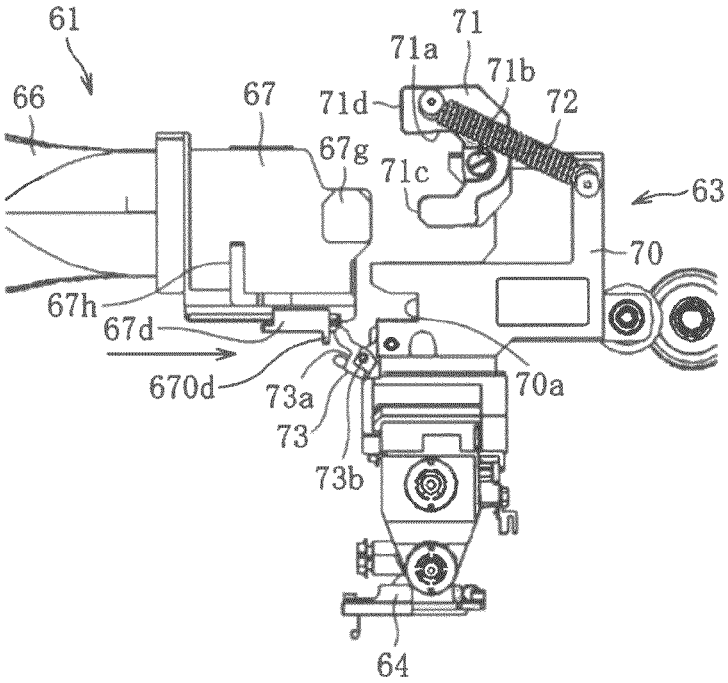
FIGS. 7A and 7B are enlarged views of a fixing unit.
Figure 7B:
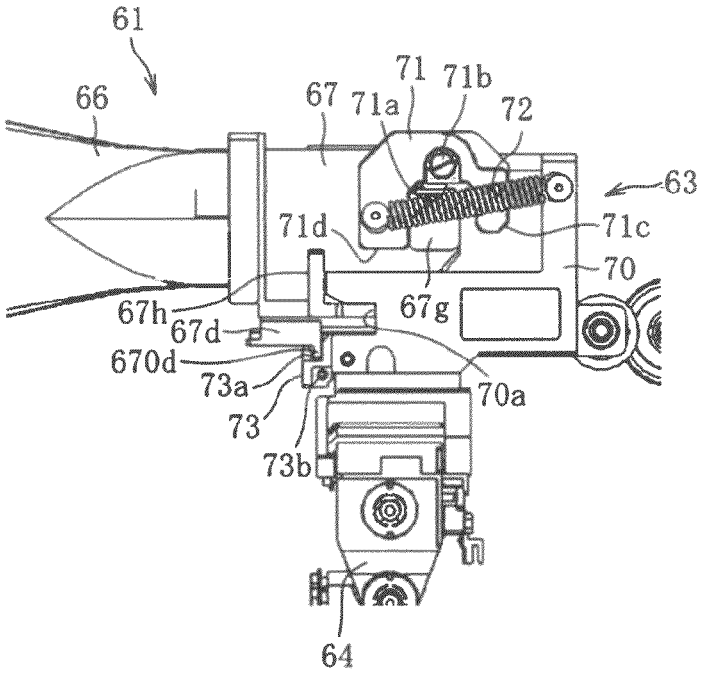

FIGS. 7A and 7B are enlarged views of the fixing unit 63. Specifically, FIG. 7A illustrates a state before the toner cartridge 61 is fixed to the fixing unit 63, and FIG. 7B illustrates a state after the toner cartridge 61 is fixed to the fixing unit 63.

As illustrated in FIGS. 7A and 7B, the fixing unit 63 includes a main body 70 connected to an upper portion of the sub hopper 64; a fixing arm 71 attached to an upper portion of the main body 70; a spring member 72 attached between the fixing arm 71 and the main body 70; and a shutter opening member 73 attached to the main body 70 on the lower side of the fixing arm 71. The fixing arm 71, the spring member 72, and the shutter opening member 73 are arranged on each of the front side and the back side in the figures.

The fixing arm 71 has an approximate C-shape with a concave portion 71*a*. The fixing arm 71 is attached to the main body 70 so that the fixing arm 71 can rotate about a horizontal support shaft 71*b* that is arranged in the center of the fixing arm 71. By rotating the fixing arm 71 about the support shaft 71*b*, the fixing arm 71 is switched between a fixation released position illustrated in FIG. 7A and a fixed position illustrated in FIG. 7B.

The spring member 72 is a tensile coil spring. One end of the spring member 72 is attached to the fixing arm 71 and the other end of the spring member 72 is attached to the main body 70. As illustrated in FIGS. 7A and 7B, when the fixing arm 71 rotates between the fixed position and the fixation released position, the end of the spring member 72 attached to the fixing arm 71 moves across a rotation fulcrum (the support shaft 71*b*) of the fixing arm 71. By causing the spring member 72 to move across the rotation fulcrum along with the rotation of the fixing arm 71, the fixing arm 71 is biased by the spring member 72 in the rotation direction.

Protrusions 67*g* as to-be-fixed portions to be fixed to the fixing arm 71 are arranged on the discharging unit 67. The protrusions 67*g* are arranged on the respective side surfaces of the discharging unit 67 (see FIG. 4A or FIG. 4C)

The shutter opening member 73 is attached to the main body 70 so that the shutter opening member 73 can rotate about a horizontal support shaft 73*b*. The shutter opening member 73 includes a concave portion 73*a* for holding a convex portion 670*d* of the slide shutter 67*d* arranged on the discharging unit 67.

A notch portion 70*a* is formed on the main body 70 of the fixing unit 63. L-shaped protrusions 67*h* that come into contact with an upper portion of the notch portion 70*a* are arranged on the respective side surfaces of the discharging unit 67.

To fix the toner cartridge 61 to the fixing unit 63, the toner cartridge 61 is first attached to the pullout tray 62 as described above with reference to FIGS. 6A and 6B. Then, the pullout tray 62 is moved in a direction in which the pullout tray 62 is housed in the apparatus main body (in the direction of the arrow X2 in FIG. 3). Along with this housing operation, as illustrated in FIG. 7A, when the discharging unit 67 of the toner cartridge 61 approaches the fixing unit 63, the protrusion 67*g* arranged on the discharging unit 67 comes into contact with one end portion 71*c* (a lower end portion in FIG. 7A) of the fixing arm 71 and causes the fixing arm 71 to rotate counterclockwise in the figure against the biasing force applied by the spring member 72. Accordingly, the fixing arm 71 is switched from the fixation released position illustrated in FIG. 7A to the fixed position illustrated in FIG. 7B. As a result, as illustrated in FIG. 7B, the protrusion 67*g* is fitted into the concave portion 71*a* of the fixing arm 71 and is sandwiched and fixed by an end portion 71*d* (a left end portion in FIG. 7B) of the fixing arm 71 and the edge of the main body 70. When the spring member 72 moves across the rotation fulcrum of the fixing arm 71 along with the rotation of the fixing arm 71, the spring member 72 applies a biasing force to the fixing arm 71 in a direction in which the fixing arm 71 is maintained at the switched position.

Furthermore, as the discharging unit 67 of the toner cartridge 61 approaches the fixing unit 63, the protrusions 67*h* arranged on the discharging unit 67 enter the notch portion 70*a* of the main body 70 and come into contact with the upper portion of the notch portion 70*a* (see FIG. 7B). Therefore, backlash of the discharging unit 67 in the vertical direction can be prevented.

Moreover, the slide shutter 67*d* arranged on the discharging unit 67 comes into contact with the shutter opening member 73 and causes the shutter opening member 73 to rotate clockwise in the figure. Accordingly, as illustrated in FIG. 7B, the convex portion 670*d* of the discharging unit 67 is inserted and held in the concave portion 73*a* of the shutter opening member 73. At this time, because the shutter opening member 73 rotates and comes into contact with the main body 70, further rotation of the shutter opening member 73 can be regulated. Therefore, the slide shutter 67*d* is pushed by the shutter opening member 73 and move to the rear side of the discharging unit 67. Consequently, the slide shutter 67*d* (a discharge port) is opened so that the toner can be discharged from the discharging unit 67 to the sub hopper 64.

As described above, the fixation of the toner cartridge 61 to the fixing unit 63 is completed.

When the fixation of the toner cartridge 61 is to be released, the pullout tray 62 is moved in the direction in which the pullout tray 62 is pulled out of the apparatus main body (in the direction of the arrow X1 in FIG. 3). With this pullout operation, the toner cartridge 61 moves to the left in FIG. 7B, so that the protrusion 67*g* arranged on the discharging unit 67 pushes the end portion 71*d* of the fixing arm 71 and causes the fixing arm 71 to rotate clockwise in the figure against the biasing force applied by the spring member 72. Accordingly, the fixing arm 71 is switched from the fixed position illustrated in FIG. 7B to the fixation released position illustrated in FIG. 7A, so that the protrusions 67*g* is separated from the fixing arm 71. At the same time, the protrusions 67*h* and the slide shutter 67*d* arranged on the discharging unit 67 are separated from the notch portion 70*a* and the shutter opening member 73, respectively, so that the fixation of the toner cartridge 61 is released. A spring or the like (not illustrated) applies a biasing force to the slide shutter 67*d* separated from the shutter opening member 73 so that the slide shutter 67*d* moves in the direction in which the discharge port is closed. Therefore, toner leakage from the discharge port can be prevented.

As described above, according to the embodiment, the rotation operation of the fixing arm 71 and the open-close operation of the slide shutter 67*d* can be performed in synchronization with the pullout/housing operation of the pullout tray 62 (the attachment/detachment operation to/from the fixing unit 63). Therefore, it is possible to easily perform the operations of fixing and releasing the fixation of the toner cartridge 61 and the operations of opening and closing the discharge port, enabling to ensure good operability. The spring member 72 applies a force to the fixing arm 71 in a rotation direction by moving across the rotation fulcrum of the fixing arm 71 along with the rotation of the fixing arm 71. Therefore, it is possible to reliably hold the fixing arm 71 at the switched position. It is also possible to prevent backlash of the discharging unit 67 in the vertical direction because the protrusions 67*h* come into contact with the notch portion 70*a*. Therefore, it is possible to stabilize the fixed state of the toner cartridge. In the embodiment, the toner containing unit 66 and the discharging unit 67 are integrated and detachably attached to the pullout tray 62. However, it is possible to fix the discharging unit 67 to the pullout tray 62 (or to the fixing unit 63) and attach and detach the toner containing unit 66 to the discharging unit 67.

Figure 8:
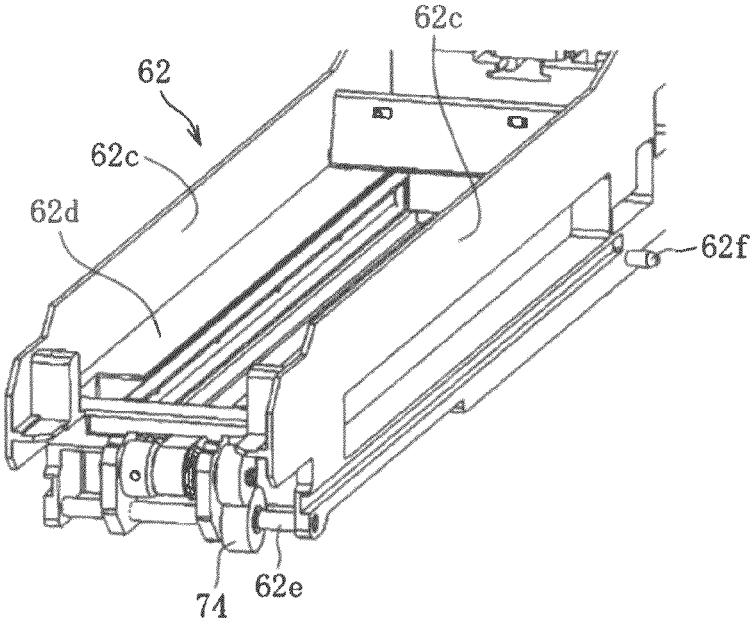
FIG. 8 is a perspective view of the pullout tray.

FIG. 8 is a perspective view of the pullout tray 62.

As illustrated in FIG. 8, the pullout tray 62 includes a pair of side walls 62*c* for supporting both side surfaces of the toner cartridge 61; and a placement surface 62*d* for placing the toner cartridge 61. A main reference shaft 62*e* to be used as a main reference at the time of attachment to the main-body frame 65 is arranged on the front end portions of the side walls 62*c* in the figure. In the embodiment, the main reference shaft 62*e* is used as a support shaft of a transmission gear 74 that transmits a driving force to a toner conveying apparatus, which will be described below. Sub reference shafts 62*f* to be used as sub reference at the time of attachment to the main-body frame 65 are arranged to respective back end portions of the side walls 62*c* in the figure.

Figure 9:
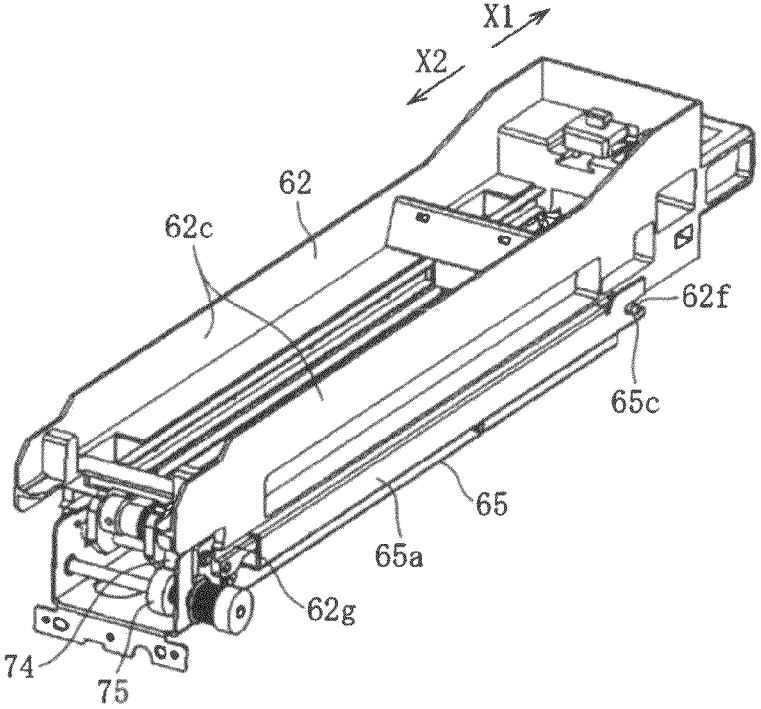
FIG. 9 is a perspective view of the pullout tray attached to a main-body frame.

FIG. 9 is a perspective view of the pullout tray 62 attached to the main-body frame 65.

As illustrated in FIG. 9, the main-body frame 65 includes a pair of guide rails 65*a* extending in the pullout direction X1 and the housing direction X2 of the pullout tray 62. An upper edge of each of the guide rails 65*a* is inserted in corresponding one of grooves 62*g* that are formed on the respective side walls 62*c* of the pullout tray 62. Therefore, the pullout tray 62 is movable in the pullout direction X1 and the housing direction X2 along the guide rails 65*a*.

Figure 10:
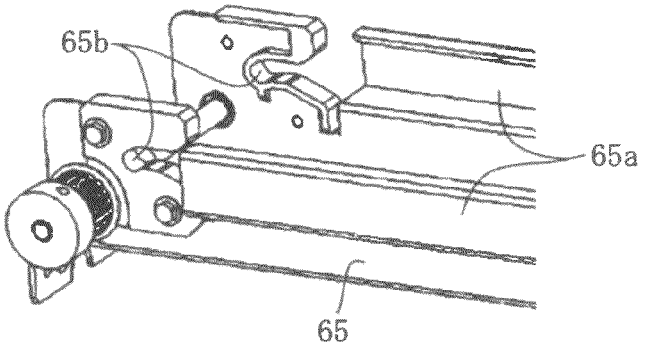
FIG. 10 is an enlarged view of the main-body frame.

First positioning concaves 65*b* that can be engaged with the main reference shaft 62*e* of the pullout tray 62 are formed on an end portion of the main-body frame 65 on the front side in the figure (see FIG. 10). Second positioning concaves 65*c* that can be engaged with the sub reference shafts 62*f* are formed on an end portion of the main-body frame 65 on the back side in the figure. Therefore, when the pullout tray 62 is moved in the housing direction X2, the main reference shaft 62*e* and the sub reference shafts 62*f* are inserted in and engaged with the first positioning concaves 65*b* and the second positioning concaves 65*c*, respectively, so that the position of the pullout tray 62 can be fixed at a predetermined position with respect to the main-body frame 65.

As illustrated in FIG. 9, a drive gear 75 that is driven by a driving device is arranged on the end portion of the main-body frame 65 on the front side in the figure. The drive gear 75 is engaged with the transmission gear 74 when the pullout tray 62 is housed and positioned in the main-body frame 65.

Figure 11:
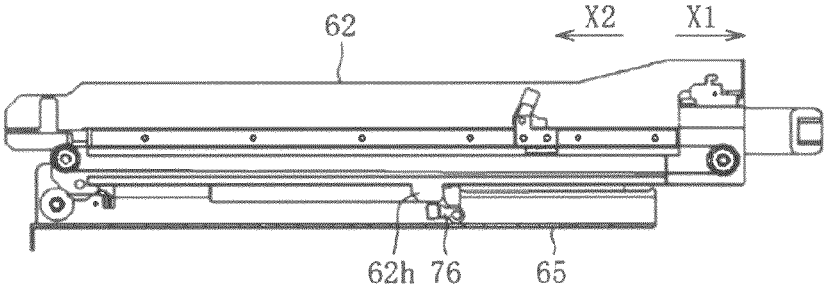
FIG. 11 is a cross-sectional side view of the main-body frame and the pullout tray.

As illustrated in FIG. 11, a pressing member 76 for pressing and fixing the pullout tray 62 is arranged on the main-body frame 65. In the embodiment, the pressing member 76 is formed as a combination of two levers. When the pullout tray 62 is moved in the housing direction X2, a convex portion 62*h* arranged on the bottom surface of the pullout tray 62 is sandwiched and pressed by the two levers so that the pullout tray 62 is pushed toward the first positioning concaves 65*b* side and the second positioning concaves 65*c* side so that the position of the pullout tray 62 can be fixed.

Figure 12:
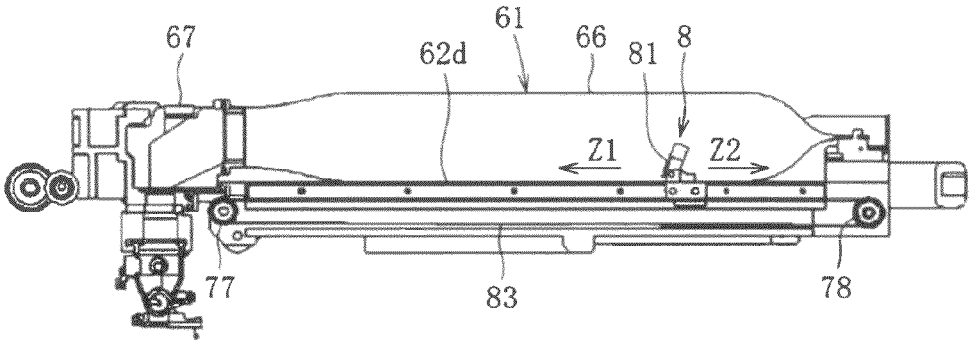
FIG. 12 is a cross-sectional side view of the pullout tray and components.

As illustrated in FIG. 12, a toner conveying apparatus (a powder conveying apparatus) 8 for conveying toner in the toner containing unit 66 toward the discharging unit 67 side is arranged on the pullout tray 62. The configuration of the toner conveying apparatus 8 will be described in detail below with reference to FIGS. 12 to 15.

Figure 13:
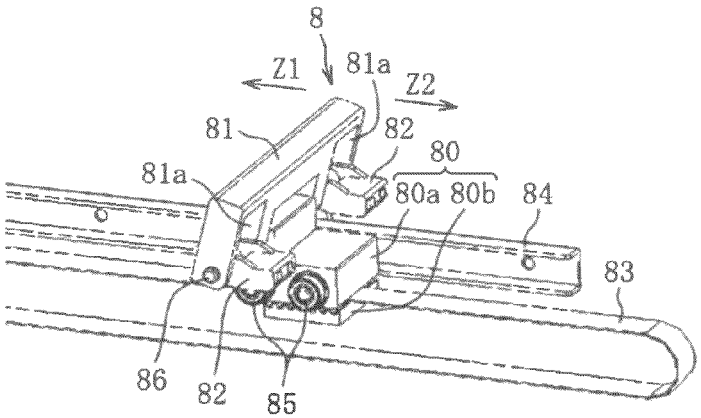
FIG. 13 is a configuration diagram of a toner conveying apparatus.

As illustrated in FIG. 13, the toner conveying apparatus 8 includes a base member 80; a delivery member 81 and a pair of leg members 82, which are attached to the base member 80; a belt member 83 as a moving means for moving the base member 80; and a pair of guide rails 84 as guide members for guiding the base member 80. In FIG. 13, illustration of the guide rail 84 on the front side is omitted.

The base member 80 is divided into an upper portion 80*a* and a lower portion 80*b*. The upper portion 80*a* and the lower portion 80*b* sandwich the belt member 83 so that the base member 80 is attached to the belt member 83. The belt member 83 is an endless belt and stretched between two rollers 77 and 78 (see FIG. 12) arranged on the pullout tray 62. The belt member 83 rotates both in the forward direction and the reverse direction upon transmission of a driving force from the transmission gear 74 (see FIG. 8) to the roller 77. By rotating the belt member 83 in the forward direction and in the reverse direction, the base member 80 can reciprocate in a delivery direction Z1 toward the discharging unit 67 and a return direction Z2 opposite to the delivery direction, together with the delivery member 81 and the leg members 82 attached to the base member 80.

Two rollers 85 as rotary members that roll on the guide rails 84 are arranged on each of the side surfaces of the base member 80. By arranging the rollers 85 on the base member 80, the base member 80 can smoothly move along the guide rails 84. The pair of the guide rails 84 is fixed to the pullout tray 62.

As illustrated in FIG. 13, the delivery member 81 and the leg members 82 are attached such that they can be opened or closed with respect to each other about a horizontal support shaft 86. More specifically, the delivery member 81 and the leg members 82 can separately rotate about the support shaft 86. When the delivery member 81 or the leg members 82 rotate about the support shaft 86, the delivery member 81 and the leg members 82 are opened or closed with respect to each other. The delivery member 81 and the leg members 82 are biased by a torsion coil spring as a biasing member (not illustrated) in a direction in which the delivery member 81 and the leg members 82 are opened with respect to each other. Housing concaves 81*a* for housing the leg members 82 when the leg members 82 are closed are formed on the delivery member 81.

Figure 14:
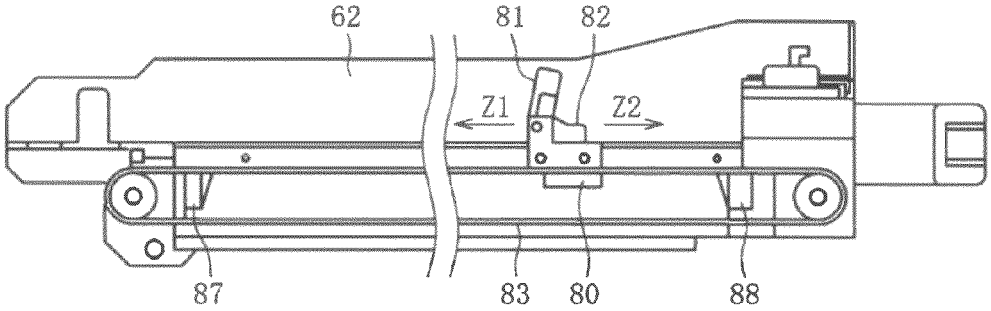
FIG. 14 is a cross-sectional side view of the pullout tray.

The rotation direction of the belt member 83 is switched by two switches 87 and 88 illustrated in FIG. 14. The switches 87 and 88 as moving-direction switching means are arranged at respective moving-direction switching positions of the delivery member 81. More specifically, the switch 87 is arranged on one end (a left end in the figure) in the delivery direction Z1 of the pullout tray 62 and the switch 88 is arranged on the other end (a right end in the figure) in the return direction Z2 of the pullout tray 62. When the delivery member 81 reaches one of the moving-direction switching positions, the base member 80 comes into contact with the switch 87 or the switch 88 arranged at this position. That is, the base member 80 functions as an input means that turns on the switch 87 or the switch 88 by coming into contact with the switch 87 or the switch 88. It is possible to arrange a non-contact sensor instead of the contact sensor such that the sensor is turned on when a to-be-detected portion (an input means) arranged on the base member 80 is brought close to the non-contact sensor.

Figure 15:
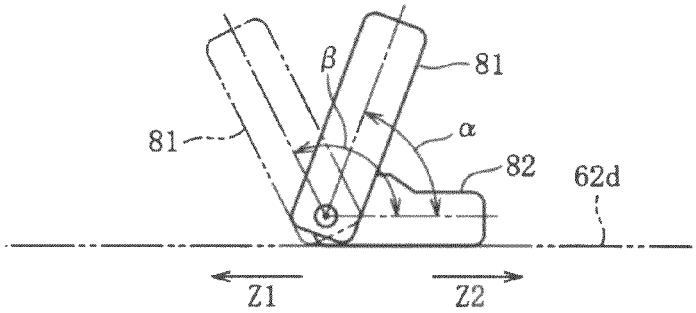
FIG. 15 is a side view of a delivery member and a leg member.

FIG. 15 is a side view of the delivery member 81 and the leg members 82.

As illustrated in FIG. 15, the leg members 82 come into contact with the placement surface 62*d* of the pullout tray 62 and can reciprocate in the delivery direction Z1 and the return direction Z2 along the placement surface 62*d*. That is, the placement surface 62*d* also has a function as a guide surface for guiding the leg members 82. As described above, the delivery member 81 and the leg members 82 are biased by the torsion coil spring so that the delivery member 81 and the leg members 82 are opened with respect to each other. The leg members 82 are supported horizontally by contact with the placement surface 62*d*. The delivery member 81 is biased so that the delivery member 81 rotates in the delivery direction Z1 (to the discharging unit 67 side) and is opened with respect to the horizontally-supported leg members 82. A regulating unit, such as a stopper (not illustrated), regulates the rotation of the delivery member 81 in the opening direction against the biasing force applied by the torsion coil spring. Therefore, the delivery member 81 is supported so as to stand with respect to the placement surface 62*d* (the state indicated by a bold line in the figure). As described above, the placement surface 62*d* and the regulating unit maintain an opening angle between the delivery member 81 and the leg members 82 to a predetermined angle $\alpha$ so that the delivery member 81 can be in a predetermined standing state with respect to the placement surface 62*d*.

An opening angle $\beta$ in FIG. 15 is an angle obtained when the delivery member 81 is not regulated by the regulating unit. That is, the angle $\beta$ is an opening angle obtained when the torsion coil spring is in a normal state. As illustrated in FIG. 15, the opening angle $\beta$ maintained by the torsion coil spring in the normal state is set in a range greater than the opening angle $\alpha$, at which the delivery member 81 is in the predetermined standing state, and smaller than 180°.

As illustrated in FIG. 6A, concave portions 62*i* and 62*j* in which the leg members 82 can be inserted are arranged on respective end portions in the directions (the delivery direction Z1 and the return direction Z2) in which the leg members 82 reciprocate on the placement surface 62*d*. In the embodiment, by arranging the concave portions 62*i* and 62*j*, the delivery member 81 can be switched between a standing state and a laid state with respect to the placement surface 62*d*.

The operations of switching the delivery member 81 between the standing state and the laid state will be described below with reference to FIGS. 16A to 16D and 17A to 17D.

Figure 16A:
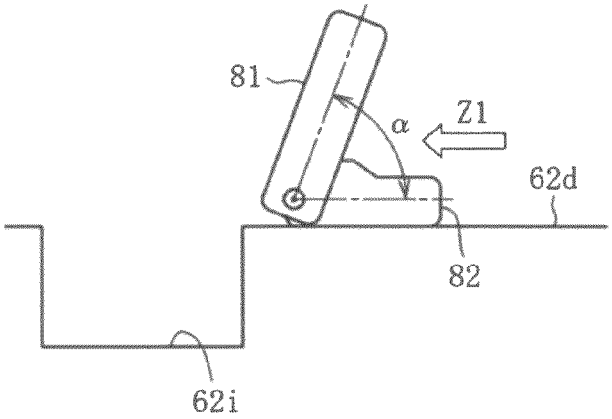
FIGS. 16A to 16D are diagrams for explaining operations for switching the delivery member from a standing state to a laid state.

FIG. 16A illustrates a state before the delivery member 81 reaches the concave portions 62*i* that are arranged on the end side in the delivery direction Z1. In this state, the opening angle between the delivery member 81 and the leg members 82 is maintained at the predetermined angle $\alpha$ by the regulating unit (not illustrated) and the placement surface 62*d*, and the delivery member 81 is in the predetermined standing state with respect to the placement surface 62*d*.

Figure 16B:
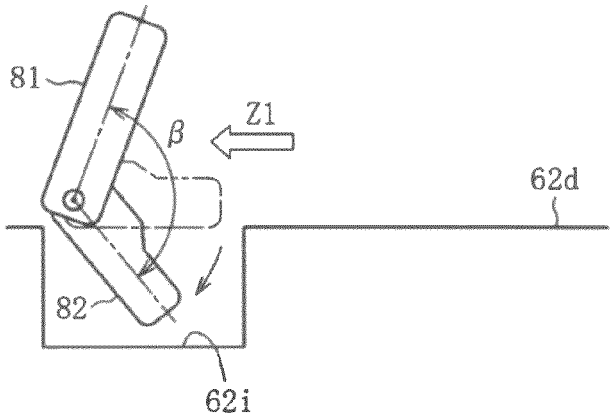

As illustrated in FIG. 16B, when the delivery member 81 moves in the delivery direction Z1 and the leg members 82 reach the positions of the concave portions 62*i*, because the placement surface 62*d* that supports the leg members 82 is not present at this position, the leg members 82 are opened downward because of the biasing force applied by the torsion coil spring (not illustrated). Therefore, the leg members 82 enter the concave portions 62*i*. The opening angle between the delivery member 81 and the leg members 82 at this time is the angle $\beta$ that is the angel maintained when the torsion coil spring is in the normal state.

When the delivery member 81 reaches the positions of the concave portions 62*i*, the base member 80 comes into contact with the switch 87 illustrated in FIG. 14, so that the moving direction of the delivery member 81 is switched.

Figure 16C:
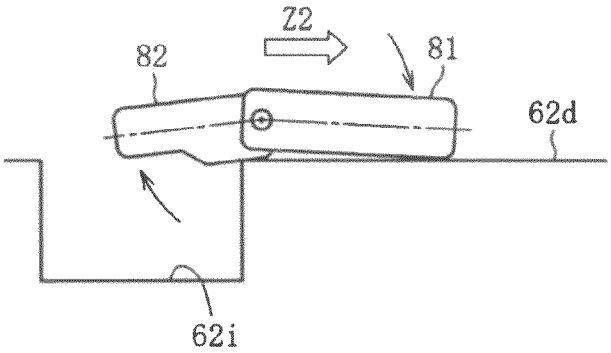

As illustrated in FIG. 16C, when the moving direction is switched and the delivery member 81 moves in the return direction Z2, the leg members 82 come into contact with the edges of the concave portions 62*i* (near the opening) and the tips of the leg members 82 are lifted upward. When the leg members 82 are lifted upward and rotate further in the opening direction, the opening angle becomes greater than the angle $\beta$. Therefore, the biasing force applied by the torsion coil spring acts in the closing direction. As a result, the delivery member 81 receives a biasing force in the closing direction and is laid on the placement surface 62*d*.

Figure 16D:
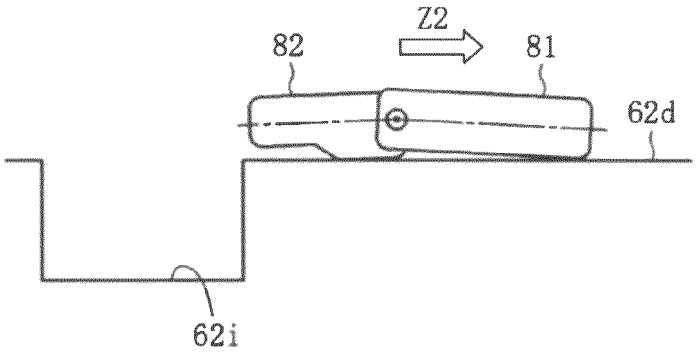

As illustrated in FIG. 16D, when the leg members 82 are separated from the concave portions 62*i*, the delivery member 81 and the leg members 82 are laid horizontally on the placement surface 62*d*. More specifically, the opening angle between the delivery member 81 and the leg members 82 is nearly 180°, so that the delivery member 81 and the leg members 82 are biased in the closing directions by the torsion coil spring. However, because the rotation of the delivery member 81 and the leg members 82 is regulated by the placement surface 62*d*, the delivery member 81 and the leg members 82 are kept laid horizontally. The delivery member 81 and the leg members 82 are configured so that they are not opened by 180° or greater.

Figure 17A:
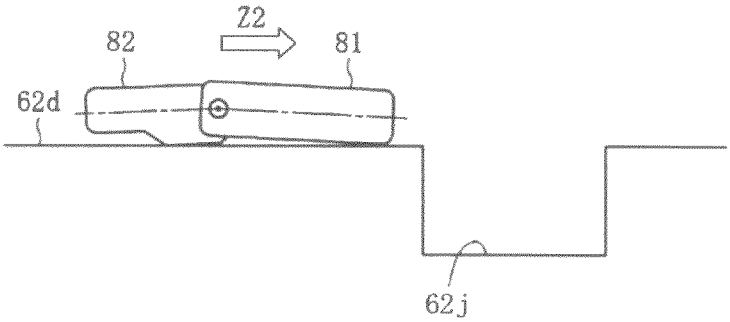
FIGS. 17A to 17D are diagrams for explaining operations for switching the delivery member from the laid state to the standing state.

FIG. 17A illustrates a state before the delivery member 81 being laid in the above manner reaches the concave portions 62*j* that are arranged on the end side in the return direction Z2. In this state, similarly to the state in FIG. 16D, the delivery member 81 and the leg members 82 are opened by nearly 180° and are laid horizontally on the placement surface 62*d*.

Figure 17B:
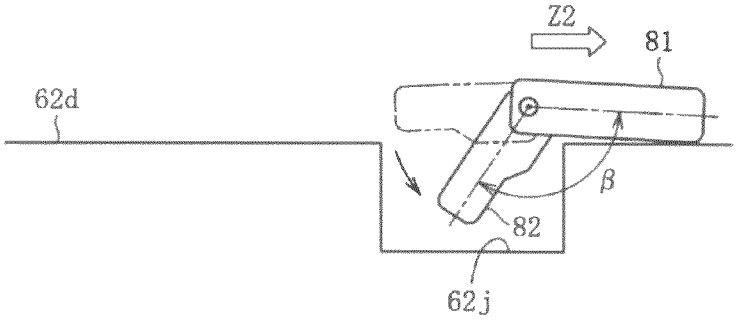

As illustrated in FIG. 17B, when the leg members 82 reach the positions of the concave portions 62*j*, because the placement surface 62*d* that supports the leg members 82 is not present at this position, the leg members 82 are closed downward because of a biasing force applied by the torsion coil spring and enter the concave portions 62*j*. The opening angle between the delivery member 81 and the leg members 82 at this time is the angle that is the angle maintained when the torsion coil spring is in the normal state. The delivery member 81 is configured so that it cannot enter the concave portions 62*j*. Therefore, the delivery member 81 passes over the concave portions 62*j*.

When the delivery member 81 reaches the positions of the concave portions 62*j*, the base member 80 comes into contact with the switch 88 illustrated in FIG. 14, so that the moving direction of the delivery member 81 is switched.

Figure 17C:
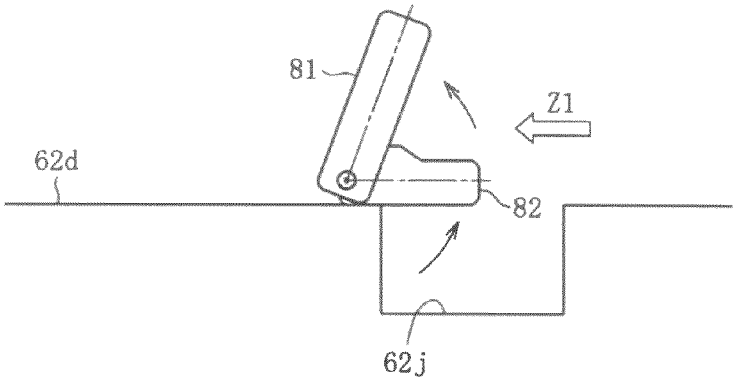

As illustrated in FIG. 17C, when the moving direction is switched and the delivery member 81 moves in the delivery direction Z1, the leg members 82 come into contact with edges of the concave portions 62*j* (near the opening) and the tips of the leg members 82 are lifted upward. When the leg members 82 are lifted upward and rotate further in the closing direction, the opening angle becomes smaller than the angle β. Therefore, the biasing force applied by the torsion coil spring acts in the opening direction. As a result, the delivery member 81 receives a biasing force in the opening direction and stands.

Figure 17D:
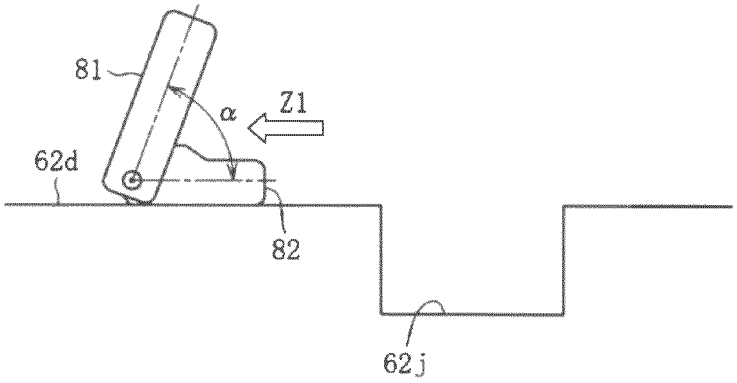

As illustrated in FIG. 17D, when the leg members 82 are separated from the concave portions 62*j*, the delivery member 81 is maintained in the standing state at the predetermined opening angle α.

A toner delivery operation (conveying operation) by the toner conveying apparatus 8 according to the present embodiment will be described below with reference to FIGS. 18A to 18C.

Figure 18A:
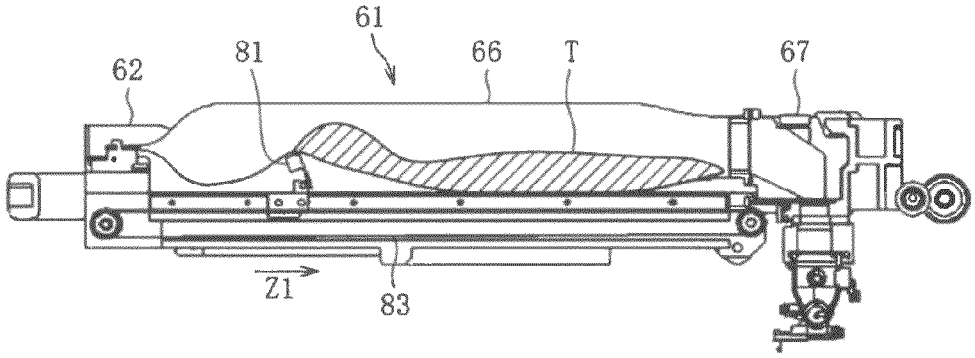
FIGS. 18A to 18C are diagrams for explaining toner delivery operations.
Figure 18B:
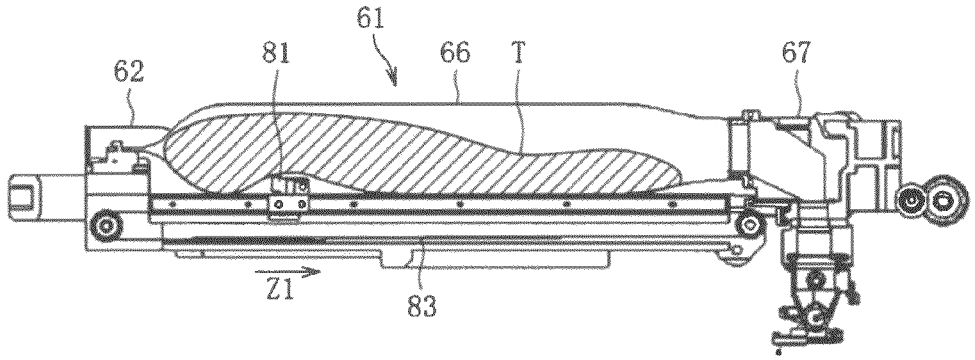
Figure 18C:
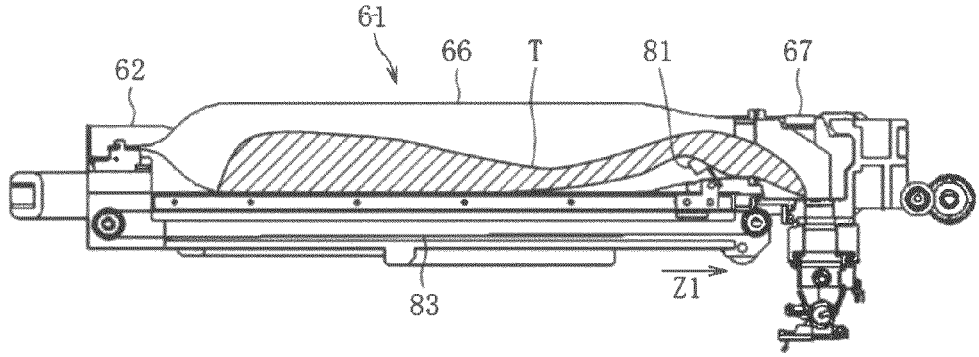

In FIGS. 18A to 18C, the toner cartridge 61 is attached to the pullout tray 62 and the pullout tray 62 is housed in the apparatus main body. Therefore, a driving device of the apparatus main body can transmit a driving force to the belt member 83 to reciprocate the delivery member 81.

FIG. 18A illustrates a state in which the remaining amount of toner T in the toner containing unit 66 is relatively reduced.

In this case, the delivery member 81 is standing because of the biasing force applied by the torsion coil spring. Therefore, the bottom surface of the toner containing unit 66 is pushed inward by the standing delivery member 81. The delivery member 81 moves in the delivery direction Z1 while pushing the toner containing unit 66 inward, so that the toner T is pushed and moved toward the discharging unit 67 by the delivery member 81. The toner T that is moved toward the discharging unit 67 side is discharged downward from the discharging unit 67 by the inertia force and weight. In the embodiment, an oscillating means (not illustrated) for slightly oscillating the discharging unit 67 is provided. By causing the oscillating means to slightly oscillate the discharging unit 67, it is possible to accelerate the discharge of the toner T from the discharging unit 67.

FIG. 18B illustrates a state in which the toner containing unit 66 contains a large amount of toner T.

As illustrated in FIG. 18B, at a portion where a large amount of toner T is present inside the toner containing unit 66, the toner containing unit 66 becomes harder because of the stuck of the toner T and becomes heavier because of the weight of the toner T. Therefore, as illustrated in FIG. 18B, the delivery member 81 is laid and the amount of push by the delivery member 81 against the toner containing unit 66 is reduced. The delivery member 81 moves in the delivery direction Z1 while being laid at the portion where the large amount of toner T is present. Thereafter, when the delivery member 81 reaches a position near the discharging unit 67 where the amount of the toner T is relatively small, the delivery member 81 stands and the amount of push by the delivery member 81 is increased as illustrated in FIG. 18C. As described above, because the delivery member 81 stands and the amount of push is increased near the discharging unit 67, the toner T is sequentially discharged from a portion that can be easily moved near the discharging unit 67.

As described above, the amount of push by the delivery member 81 is changed by switching the delivery member 81 between the standing state and the laid state in accordance with the amount of toner inside the toner containing unit 66. Therefore, it is possible to stably and reliably convey the toner to the discharging unit 67 regardless of the remaining amount of the toner inside the toner containing unit 66. Furthermore, the delivery member 81 can deliver the toner with low stress, so that it is possible to prevent toner aggregation or toner deterioration. Moreover, the delivery member 81 conveys toner without causing large oscillation or large shock, so that it is possible to prevent abnormal images due to the oscillation or the shock.

It is possible to adjust the pushing force of the delivery member 81 to an appropriate value by appropriately changing a biasing force, which is applied to the delivery member 81 by the torsion coil spring, depending on the material (flexibility or the like) or the maximum toner capacity of the toner containing unit 66. In this case, even when the biasing force applied by the torsion coil spring is increased, because the rotation of the delivery member 81 can be regulated by the regulating unit (not illustrated) in the embodiment, it is possible to maintain the predetermined standing state of the delivery member 81.

In the embodiment, because the base member 80 comes into contact with the switches 87 and 88 to switch the moving direction of the delivery member 81 between the delivery direction Z1 and the return direction Z2. Therefore, it is possible to continuously deliver the toner.

When the delivery member 81 is returned to the initial position, the delivery member 81 is switched to the laid state. Therefore, it is possible to prevent the delivery member 81 moving in the return direction Z2 from conveying the toner backward. Furthermore, as described with reference to FIGS. 16A to 16D and 17A to 17D, the operation of switching the delivery member 81 between the standing state and the laid state can be realized by a simple mechanism in which the leg members 82 are inserted into the concave portions 62*i* or the concave portions 62*j*. Therefore, it is possible to simplify the overall configuration. It may be possible to use through holes instead of the concave portions 62*i* and 62*j*.

In the above embodiment, the entire toner containing unit 66 is formed of a deformable member. However, only a portion to be pushed by the delivery member 81 may be formed by using a deformable member. To prevent abrasion of the bottom surface of the toner containing unit 66 (the surface contacting the delivery member 81) due to sliding contact with the delivery member 81, it is possible to increase the abrasion resistance of the bottom surface of the toner containing unit 66 or to form the bottom surface by using a thin film that has a small coefficient of friction and that is formed through various methods, such as PVD (physical vapor deposition) or CVD (chemical vapor deposition). It is also possible to prevent the abrasion by arranging a mechanism that applies lubricant to at least one of the delivery member 81 and the toner containing unit 66 so that the friction between the delivery member 81 and the toner containing unit 66 can be reduced.

When the toner containing unit 66 becomes empty of toner because the toner in the toner containing unit 66 is delivered and consumed as described above, the used toner cartridge 61 is replaced with new one. The replacement timing is notified to a user in the following manner. For example, a toner detection sensor is arranged in the sub hopper and when the toner detection sensor detects absence of toner, it is determined that the toner containing unit 66 is empty of toner and a signal is sent.

A method of replacing the toner cartridge 61 will be described below.

When the toner containing unit 66 becomes empty of toner, the pullout tray 62 is pulled out and the toner containing unit 66 and the discharging unit 67 are integrally (as the toner cartridge 61) detached from the pullout tray 62. The toner cartridge 61 is detached in the manner as described above with reference to FIGS. 6A, 6B, 7A, and 7B.

Figure 19A:
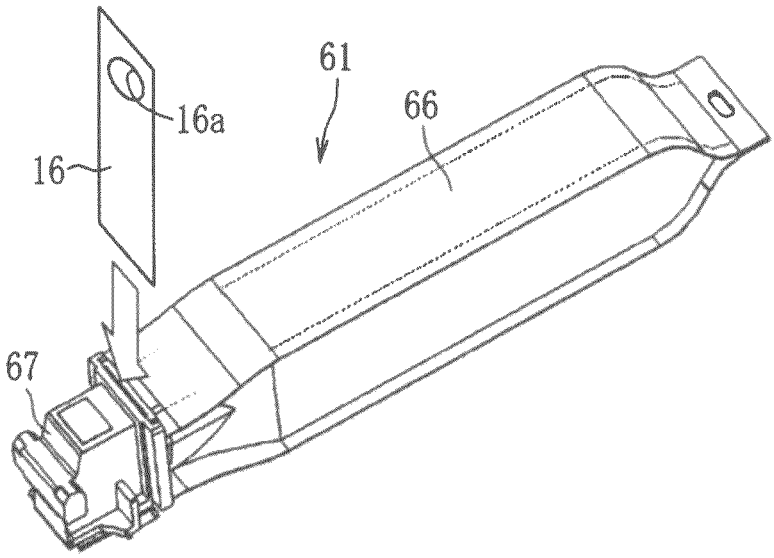
FIGS. 19A and 19B are diagrams illustrating a state in which a blocking member is inserted between a used toner containing unit and a discharging unit.
Figure 19B:
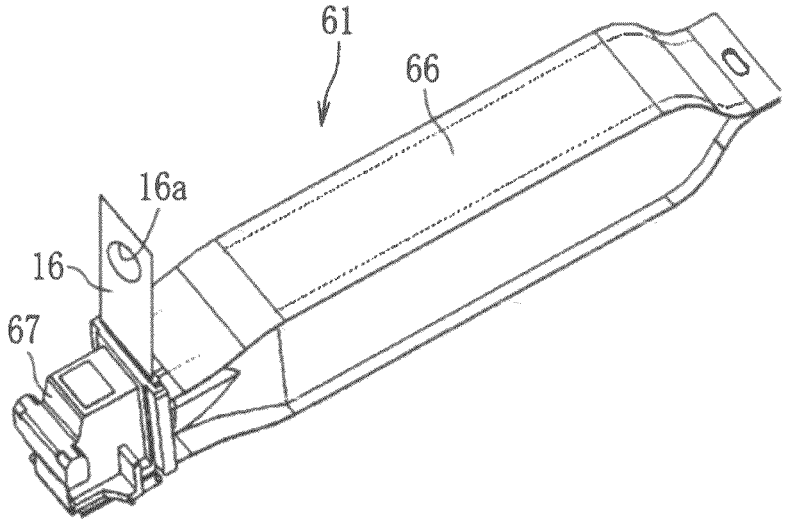

As illustrated in FIGS. 19A and 19B, a sheet-shaped blocking member 16 is inserted between the toner containing unit 66 and the discharging unit 67 that are connected to each other in the used toner cartridge 61. When the blocking member 16 is inserted, a part of the blocking member 16 is exposed between the toner containing unit 66 and the discharging unit 67. A hole portion 16*a*, which can be held by fingers or the like when the blocking member 16 is to be removed, is arranged on the exposed portion.

Figure 20:
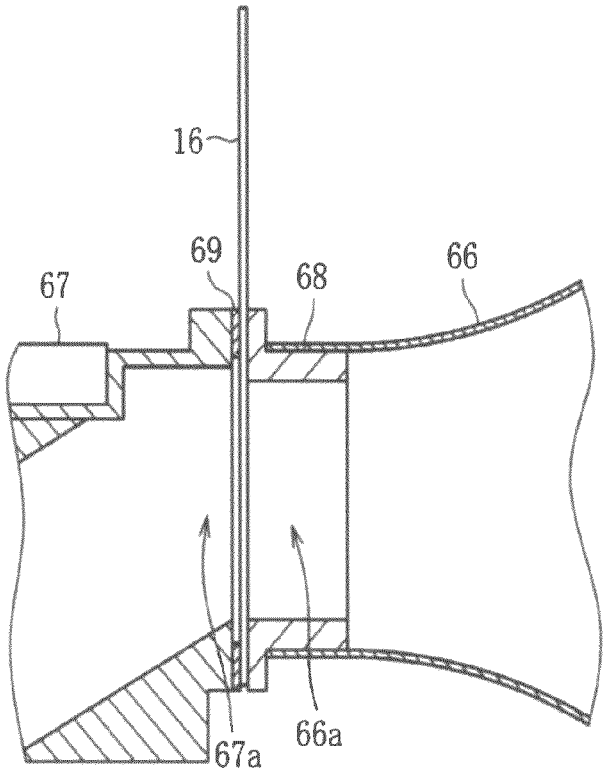
FIG. 20 is an enlarged cross-sectional view of a connected portion between the used toner containing unit and the discharging unit with the blocking member inserted.

FIG. 20 is an enlarged cross-sectional view of a connected portion between the used toner containing unit 66 and the discharging unit 67 with the blocking member inserted.

As illustrated in FIG. 20, when the blocking member 16 is inserted between the toner containing unit 66 and the discharging unit 67, the blocking member 16 is interposed between the elastic member 69 arranged on the discharging unit 67 and the opening holder member 68 arranged on the toner containing unit 66. Before the blocking member 16 is inserted, the toner containing unit 66 is in contact with an end face of the opening holder member 68 opposing to the toner containing unit 66 (not illustrated). However, when the blocking member 16 is inserted, the elastic member 69 is elastically deformed (compressed) along with the insertion so that the blocking member 16 is interposed between the elastic member 69 and the end face of the opening holder member 68.

Figure 21:
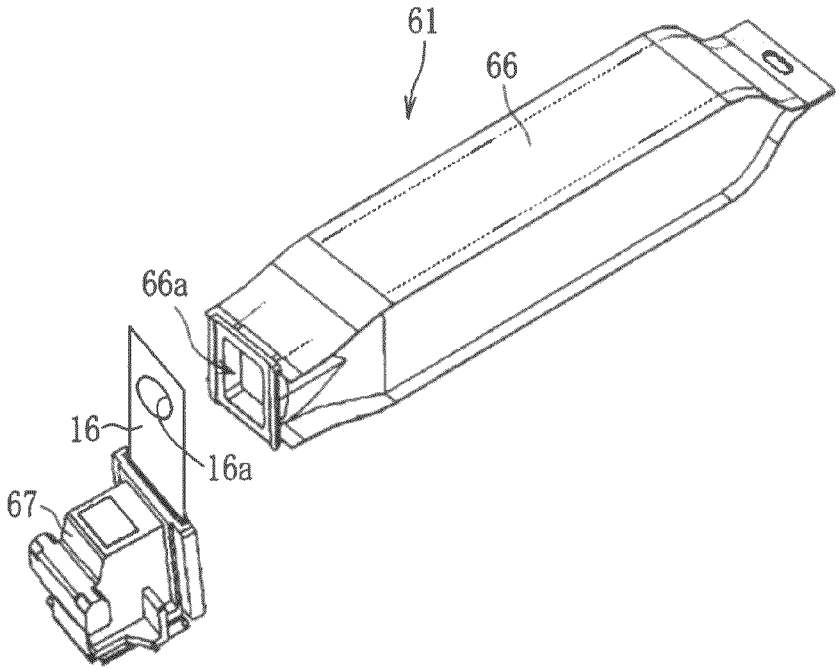
FIG. 21 is a diagram illustrating a state in which the used toner containing unit is separated from the discharging unit.

After the blocking member 16 is inserted between the toner containing unit 66 and the discharging unit 67 as described above, the toner containing unit 66 and the discharging unit 67 are separated as illustrated in FIG. 21. The toner containing unit 66 and the discharging unit 67 are separated by sliding the opening holder member 68 arranged on the toner containing unit 66 upward along the grooves 67*e* arranged on the discharging unit 67 as illustrated in FIGS. 5A to 5C and releasing the engagement between the opening holder member 68 and the grooves 67*e*. When the toner containing unit 66 and the discharging unit 67 are separated, the blocking member 16 is held on the discharging unit 67 side. More specifically, the blocking member 16 is held such that the both edges of the blocking member 16 are inserted into the grooves 67*e* arranged on the discharging unit 67. Because the blocking member 16 is held on the discharging unit 67 after the toner containing unit 66 is separated, the inlet 67*a* (see FIGS. 5A to 5C) of the discharging unit 67 can be blocked by the blocking member 16.

Figure 22A:
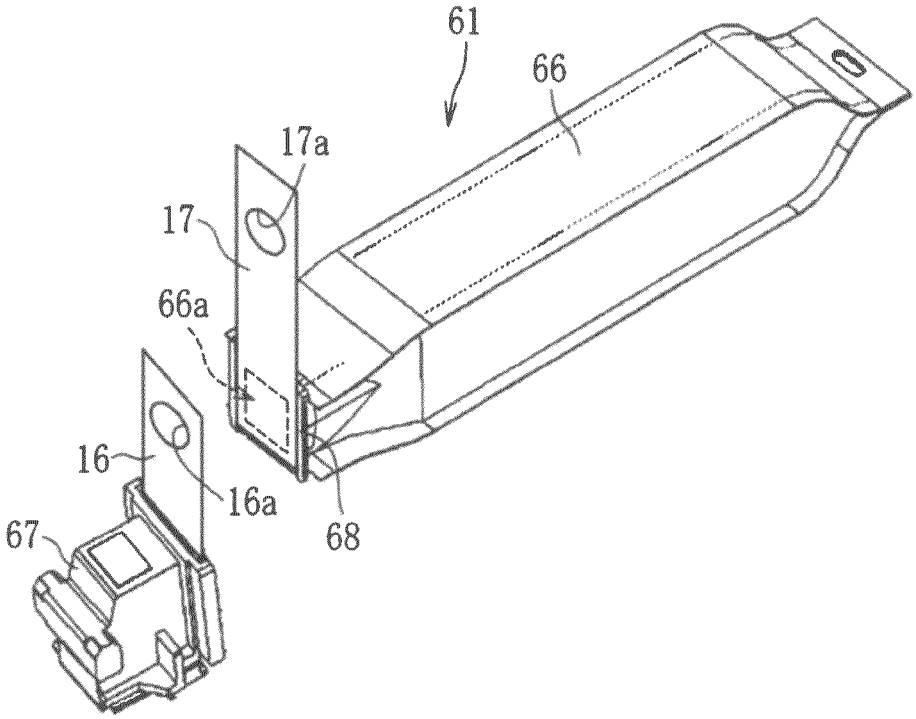
FIGS. 22A and 22B are diagrams illustrating a state in which a new toner containing unit is attached to the discharging unit.
Figure 22B:
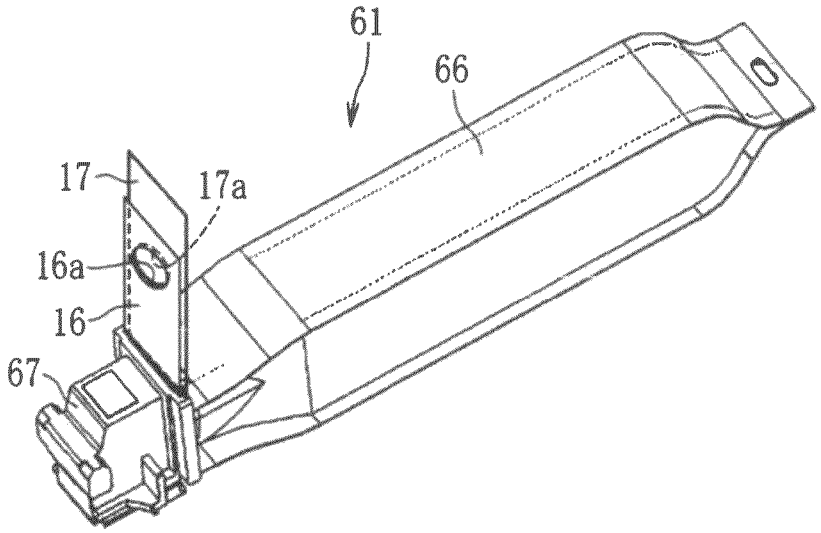

The toner containing unit 66 illustrated in FIGS. 22A and 22B is a new toner containing unit filled with toner.

As illustrated in FIG. 22A, a sheet-shaped seal member 17 is arranged on the opening holder member 68 of the new toner containing unit 66 so that the opening 66*a* of the toner containing unit 66 is sealed by the seal member 17. The seal member 17 is detachably attached to the periphery of the opening of the opening holder member 68 by adhesive agent. Similarly to the blocking member 16, a hole portion 17*a*, which can be held by fingers or the like when the seal member 17 is to be removed, is arranged on an upper portion of the seal member 17 in the figure.

As illustrated in FIG. 22B, the new toner containing unit 66 with the attached seal member 17 is mounted on the discharging unit 67. The toner containing unit 66 is attached such that, as described above with reference to FIGS. 5A to 5C, the opening holder member 68 arranged on the toner containing unit 66 is slid downward along the grooves 67*e* arranged on the discharging unit 67 and the opening holder member 68 and the grooves 67*e* are engaged with each other. When the toner containing unit 66 is attached to the discharging unit 67, the seal member 17 and the blocking member 16 are sandwiched by the toner containing unit 66 and the discharging unit 67 such that the seal member 17 and the blocking member 16 are opposing to each other. In this state, the hole portions 16*a* and 17*a* of the blocking member 16 and the seal member 17 overlap each other.

Figure 23:
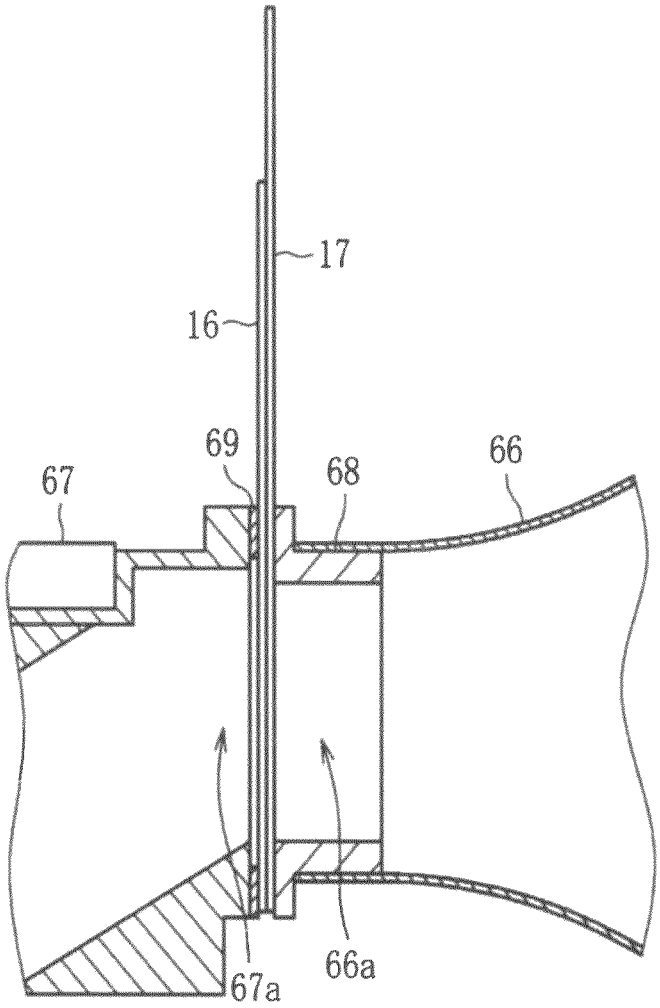
FIG. 23 is an enlarged cross-sectional view of a connected portion between the new toner containing unit and the discharging unit with the blocking member and a seal member inserted.

FIG. 23 is an enlarged cross-sectional view of a connected portion between the new toner containing unit and the discharging unit with the blocking member 16 and the seal member 17 inserted.

As illustrated in FIG. 23, when the toner containing unit 66 is attached to the discharging unit 67, the blocking member 16 and the seal member 17 are sandwiched by the discharging unit 67 and the toner containing unit 66 via the elastic member 69.

In the state illustrated in FIG. 22B, the blocking member 16 and the seal member 17 are pulled upward with fingers or the like holding the hole portions 16*a* and 17*a* arranged on the exposed portions of the blocking member 16 and the seal member 17, so that the blocking member 16 and the seal member 17 are removed from between the toner containing unit 66 and the discharging unit 67. Consequently, the opening of the toner containing unit 66 and the inlet of the discharging unit 67 communicate with each other.

The toner cartridge 61 in which the new toner containing unit 66 and the discharging unit 67 are integrated with each other is placed on the pullout tray 62 and the pullout tray 62 is housed in the apparatus main body of the image forming apparatus so that the toner cartridge 61 is set at a predetermined position. Accordingly, the replacement operation is completed.

The replacement operation of the toner cartridge 61 has been described above. In the embodiment, only the toner containing unit 66 can be replaced by separating the used toner containing unit 66 from the discharging unit 67 as described above. Therefore, it is not necessary to integrally replace the toner containing unit 66 and the discharging unit 67. Consequently, it is possible to repeatedly use the discharging unit 67 and minimize the number of components that need to be replaced, enabling to save costs and resources. Furthermore, because the toner containing unit 66 is deformable, the used toner containing unit 66 can be made compact by, for example, folding the used toner containing unit 66. Therefore, it becomes easy to carry the used toner containing unit 66 and it is possible to effectively reduce costs for transporting wastes and reduce environmental loads on waste incineration.

It may be possible to form a crease in advance on the toner containing unit 66 so that when the amount of toner contained in the toner containing unit 66 is reduced, the toner containing unit 66 can be folded along the crease through the delivery operation. In this case, it is possible to allow an operator to omit operations of folding the toner containing unit 66. Furthermore, it becomes possible to easily deform the toner containing unit 66, so that the toner can be easily discharged.

In the embodiment, the sheet-shaped blocking member 16 is inserted between the toner containing unit 66 and the discharging unit 67 before the used toner containing unit 66 is separated from the discharging unit 67 (see FIGS. 19A and 19B). Therefore, it is possible to block the inlet of the discharging unit 67 by the blocking member 16 after the separation (see FIG. 21). Consequently, it is possible to prevent such trouble that an operator, such as a user or a serviceman, becomes stained by touching toner remaining in the discharging unit 67 through the inlet 67*a*. It is also possible to prevent the remaining toner from being leaked or scattered to the outside from the inlet 67*a*. Meanwhile, although the opening 66*a* of the separated toner containing unit 66 is opened, almost no toner remains inside the used toner containing unit 66. Therefore, there is less possibility that the operator may touch the toner or that the toner may be leaked to the outside.

The elastic member 69 is interposed between the toner containing unit 66 and the discharging unit 67. Therefore, when the blocking member 16 is inserted between the toner containing unit 66 and the discharging unit 67, the elastic member 69 is elastically deformed, so that it becomes possible to easily insert the blocking member 16 while preventing toner leakage. When the blocking member 16 and the seal member 17 are removed from between the new toner containing unit 66 and the discharging unit 67, the elastic member 69 is elastically restored and seals the gap between the toner containing unit 66 and the discharging unit 67. Therefore, even in this case, toner leakage can hardly occur. Furthermore, because the blocking member 16 and the seal member 17 are sandwiched via the elastic member 69, they can be easily pulled out.

In the embodiment, a direction in which the blocking member 16 and the seal member 17 are removed (pulled out) is the same as the direction in which the toner containing unit 66 is detached (separated) from the discharging unit 67 (the upward direction in FIG. 22B). Therefore, it is possible to remove the blocking member 16 and the seal member 17 with a simple structure and to reliably prevent toner leakage.

As illustrated in FIG. 22B, the hole portions 16*a* and 17*a* of the blocking member 16 and the seal member 17 are arranged at the similar positions so as to overlap each other. Therefore, the blocking member 16 and the seal member 17 can be easily and collectively pulled out. The hole portions 16*a* and 17*a* may partly overlap each other at the same position.

In the embodiment, the toner containing unit 66 and the discharging unit 67 are configured so that the toner containing unit 66 can be attached to and detached from the discharging unit 67 from above. In this case, the toner containing unit 66 can be attached and detached from above while pushing the discharging unit 67 in the state where the toner cartridge 61 is placed sideways on a table or the like. Therefore, attachment/detachment operation can be easily performed. In particular, when the configuration is intended so that a user will replace the toner cartridge, the above configuration is preferable because the operability can be improved. On the other hand, when the configuration is intended so that any person, such as a serviceman, other than a user will replace the toner cartridge, it is preferable to configure such that the toner containing unit 66 is attached to and detached from the discharging unit 67 from below in order to reduce the possibility that a user may erroneously detach the toner containing unit 66 from the discharging unit 67. As described above, it is possible to appropriately change the attachment/detachment directions of the toner containing unit 66 depending on persons who replace the toner cartridge.

The present invention is not limited to the above embodiments. Various modifications may be made without departing from the scope of the present invention. The above embodiments are described with an example in which the configuration of the present invention is applied to a toner container that contains, as powder, developer formed of toner. However, the configuration of the present invention may be applied to a toner container that houses developer formed of toner and magnetic carrier. Furthermore, the configuration of the present invention may be applied to a powder container that contains powder other than toner. The powder conveying apparatus according to the present invention may be installed in other printers, copiers, facsimile machines or multifunction peripherals, instead of the printer as illustrated in FIG. 1.

As described above, according to the present embodiment, a seal member arranged on the powder containing unit, which contains powder, such as toner, can be removed after the seal member is sandwiched between the powder containing unit and the discharging unit. Therefore, the opening and the inlet can communicate with each other while the powder containing unit and the discharging unit are connected to each other. Consequently, it is possible to reduce the possibility that an operator may touch the powder in the powder containing unit or powder may be leaked or scattered from the powder containing unit. Furthermore, because the elastic member is interposed between the powder containing unit and the discharging unit, it is possible to easily remove the seal member. Moreover, because the elastic member seals the gap between the powder containing unit and the discharging unit after the seal member is removed, it is possible to prevent powder leakage.

In the above embodiments, the powder containing unit (the toner containing unit) and the discharging unit can be separated from each other and the seal member is sandwiched between the powder containing unit and the discharging unit. However, even in the configuration in which the powder containing unit and the discharging unit are not separated from each other, if the seal member is sandwiched between the powder containing unit and the discharging unit via the elastic member, it is possible to achieve the same advantages as those of the embodiments.

The present embodiment has been made in view of the above and it is an object of the present embodiment to provide a powder container capable of reducing the possibility that a user may touch powder in the powder container or the powder may be leaked or scattered from the powder container and to provide a powder conveying apparatus and an image forming apparatus that include the powder container.

According to an aspect of the present embodiment, the seal member can be removed after the seal member is sandwiched between the powder containing unit and the discharging unit. Therefore, the opening and the inlet can communicate with each other while the powder containing unit and the discharging unit are connected to each other. Consequently, it is possible to reduce the possibility that an operator may touch the powder in the powder containing unit or powder may be leaked or scattered from the powder containing unit. Furthermore, because the elastic member is interposed between the powder containing unit and the discharging unit, it is possible to easily remove the seal member. Moreover, because the elastic member seals the gap between the powder containing unit and the discharging unit after the seal member is removed, it is possible to prevent powder leakage.

According to another aspect of the present embodiment, when the seal member is to be removed, it is possible to hold the hook hole portion with fingers or the like. Therefore, it is possible to easily remove the seal member.

According to still another aspect of the present embodiment, because the powder containing unit and the discharging unit can be separated from each other, it is possible to replace only the used toner container with new one. Therefore, it is possible to repeatedly use the discharging unit and minimize the number of components that need to be replaced, enabling to save costs and resources.

According to still another aspect of the present embodiment, the direction in which the seal member is removed is the same as the direction in which the powder containing unit is detached from the discharging unit. Therefore, it is possible to remove the seal member with a simple configuration, enabling to reliably prevent powder leakage.

According to still another aspect of the present embodiment, the blocking member is inserted between the discharging unit and the powder containing unit such that the inlet of the discharging unit can be blocked. Therefore, it is possible to prevent the powder inside the discharging unit from being leaked to the outside when the discharging unit and the powder containing unit are separated from each other. Furthermore, because the inlet is blocked by the blocking unit, it is possible to prevent an operator from touching the toner inside the discharging unit through the inlet.

According to still another aspect of the present embodiment, when the blocking member is to be removed from between the powder containing unit and the discharging unit, it is possible to hold a hook hole portion with fingers or the like. Therefore, it is possible to easily remove the blocking member.

According to still another aspect of the present embodiment, the hook hole portions of the seal member and the blocking member are arranged at the same positions, so that the seal member and the blocking member can be easily and collectively removed.

According to still another aspect of the present embodiment, the attachment/detachment operation of the powder containing unit can be improved, improving the operability.

According to still another aspect of the present embodiment, it is possible to reduce the possibility that the powder containing unit is erroneously detached from the discharging unit.

According to still another aspect of the present embodiment, the powder conveying apparatus includes the powder container described above. Therefore, the powder conveying apparatus can achieve the same advantages as those described above.

According to still another aspect of the present embodiment, an image forming apparatus includes the above powder containing apparatus. Therefore, the image forming apparatus can achieve the same advantages as those of the powder containing unit included in the powder conveying apparatus.

According to still another aspect of the present embodiment, the seal member can be removed after the seal member is sandwiched between the powder containing unit and the discharging unit. Therefore, it is possible to reduce the possibility that an operator may touch the powder inside the powder containing unit or the powder may be leaked or scattered to the outside from the powder containing unit. Furthermore, the elastic member is interposed between the powder containing unit and the discharging unit, so that the seal member can be easily removed. Moreover, because the elastic member seals the gap between the powder containing unit and the discharging unit after the seal member is removed, it is possible to prevent powder leakage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container comprising:

a powder containing unit that contains powder and at least a part of which is deformable;

a discharging unit that receives the powder supplied from an opening of the powder containing unit via an inlet arranged on the discharging unit and discharges the powder to a supply destination; and a seal member that is sandwiched between the discharging unit and the powder containing unit such that the seal member is removable from between the discharging unit and the powder containing unit.

2. The powder container according to claim 1, wherein the powder containing unit and the discharging unit are separable from each other.

3. The powder container according to claim 2, wherein a direction in which the seal member is removed from between the discharging unit and the powder containing unit is the same as a direction in which the powder containing unit is detached from the discharging unit.

4. The powder container according to claim 1, further comprising a blocking member that is inserted between the discharging unit and the powder containing unit and blocks the inlet of the discharging unit.

5. The powder container according to claim 1, wherein the seal member is arranged on the powder containing unit and seals the opening.

6. The powder container according to claim 4, wherein the blocking member is arranged on the discharging unit and seals the inlet.

7. A powder container comprising:

a powder containing unit that contains powder and at least a part of which is deformable;

a discharging unit that receives the powder supplied from an opening of the powder containing unit via an inlet arranged on the discharging unit and discharges the powder to a supply destination;

an elastic member that is arranged on a periphery of the inlet of the discharging unit; and a seal member that is arranged on the powder containing unit and seals the opening, wherein the seal member is sandwiched between the discharging unit and the powder containing unit via the elastic member such that the seal member is removable from between the discharging unit and the powder containing unit.

8. The powder container according to claim 7, wherein the seal member has a hole portion, the hole portion being used for gripping, on an exposed portion of the seal member that is exposed when the seal member is sandwiched between the discharging unit and the powder containing unit.

9. The powder container according to claim 7, wherein the powder containing unit and the discharging unit are separable from each other.

10. The powder container according to claim 9, wherein a direction in which the seal member is removed from between the discharging unit and the powder containing unit is the same as a direction in which the powder containing unit is detached from the discharging unit.

11. The powder container according to claim 9, further comprising a blocking member that is inserted between the discharging unit and the powder containing unit and blocks the inlet of the discharging unit.

12. The powder container according to claim 11, wherein the blocking member has a hole portion, the hole portion being used for gripping, on an exposed portion of the blocking member that is exposed when the blocking member is inserted between the discharging unit and the powder containing unit.

13. The powder container according to claim 12, wherein when the seal member is sandwiched between the discharging unit and the powder containing unit and the blocking member is inserted between the discharging unit and the powder containing unit, the hole portion of the seal member and the hole portion of the blocking member are located at the same position.

14. The powder container according to claim 9, wherein the powder containing unit is configured to be attached to and detached from the discharging unit from above.

15. The powder container according to claim 9, wherein the powder containing unit is attached to and detached from the discharging unit from below.

16. A powder conveying apparatus comprising:

a powder containing unit that contains powder and at least a part of which is deformable;

a discharging unit that receives the powder supplied from an opening of the powder containing unit via an inlet arranged on the discharging unit and discharges the powder to a supply destination;

a delivery member that moves toward the discharging unit while pushing a deformable portion of the powder containing unit inward, thereby delivering the powder to the discharging unit; and the powder container according to claim 1.

17. An image forming apparatus comprising the powder conveying apparatus according to claim 16.

* * * * *